US009649008B2

(12) United States Patent
Kim et al.

(10) Patent No.: US 9,649,008 B2
(45) Date of Patent: May 16, 2017

(54) DISHWASHING MACHINE AND METHOD FOR CONTROLLING THE SAME

(71) Applicant: SAMSUNG ELECTRONICS CO., LTD., Suwon-si, Gyeonggi-do (KR)

(72) Inventors: Hyung Gyu Kim, Uiwang-si (KR); Hyoung Jun Kim, Uiwang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 154 days.

(21) Appl. No.: 14/585,400

(22) Filed: Dec. 30, 2014

(65) Prior Publication Data

US 2015/0182098 A1 Jul. 2, 2015

(30) Foreign Application Priority Data

Dec. 31, 2013 (KR) ..... 10-2013-0169376

(51) Int. Cl.
*A47L 15/42* (2006.01)
*A47L 15/16* (2006.01)
*A47L 15/00* (2006.01)

(52) U.S. Cl.
CPC ..... *A47L 15/4282* (2013.01); *A47L 15/0049* (2013.01); *A47L 15/16* (2013.01); *A47L 2301/08* (2013.01); *A47L 2401/14* (2013.01); *A47L 2401/24* (2013.01); *A47L 2401/30* (2013.01); *A47L 2401/34* (2013.01); *A47L 2501/04* (2013.01); *A47L 2501/26* (2013.01); *A47L 2501/32* (2013.01)

(58) Field of Classification Search
CPC ..... A47L 15/4282
See application file for complete search history.

(56) References Cited

U.S. PATENT DOCUMENTS

2009/0078288 A1* 3/2009 Son ..... A47L 15/0049 134/18
2013/0319487 A1* 12/2013 Hong ..... A47L 15/06 134/183

OTHER PUBLICATIONS

European Decision on Grant dated Jul. 21, 2016 in corresponding European Patent Application No. 14 199 878.1.

* cited by examiner

*Primary Examiner* — Jason Ko
(74) *Attorney, Agent, or Firm* — Staas & Halsey LLP

(57) ABSTRACT

Provided is a dishwashing machine determining whether a nozzle spraying washing water is clogged, and a method for controlling the same. In according to one aspect, the dishwashing machine may include a main body; a washing tub provided in the main body; a basket provided in the washing tub for accommodating dishes; a plurality of fixed nozzles fixedly arranged in a first direction of the washing tub and spraying washing water in a second direction; a vane provided for deflecting washing water sprayed from the fixed nozzles towards dishes accommodated in the basket, the vane being linearly reciprocated in the second direction; and a controller determining whether the vane is linearly reciprocated in the second direction in parallel with the first direction.

13 Claims, 20 Drawing Sheets

DISHWASHING MACHINE AND METHOD FOR CONTROLLING THE SAME

CROSS-REFERENCE TO RELATED APPLICATION

This application claims the benefit of Korean Patent Application No. 10-2013-0169376, filed on Dec. 31, 2013 in the Korean Intellectual Property Office, the disclosure of which is incorporated herein by reference.

BACKGROUND

1. Field

Embodiments of the present invention relate to a dishwashing machine having a deflection plate which is linearly reciprocated in a washing tub and converts the direction of washing water, and a method for controlling the same.

2. Description of the Related Art

A dishwashing machine is a home appliance provided with a main body in which a washing tub is provided, a basket for receiving dishes therein, a sump for collecting and storing washing water, a washing pump for pumping washing water, a spray unit for spraying washing water, and a connecting flow channel connecting the washing pump to the spray unit, and sprays high-pressure washing water to dishes to wash dishes.

Here, the spray unit may have a variety of structures. For example, the spray unit may be provided to be rotated in a washing tub or to be linearly reciprocated in the washing tub.

In addition, the spray unit itself is secured to one point of the washing tub to spray washing water approximately in the horizontal direction, and a deflection plate deflecting washing water sprayed from the spray unit to dishes may be linearly reciprocated.

SUMMARY

Therefore, it is an aspect of an embodiment to provide a dishwashing machine which determines whether a nozzle for spraying washing water is clogged, and a method for controlling the same.

In accordance with one aspect of an embodiment, a dishwashing machine may include a main body; a washing tub provided in the main body; a basket provided in the washing tub for accommodating dishes; a plurality of fixed nozzles fixedly arranged in a first direction of the washing tub and spraying washing water in a second direction; a vane provided for deflecting washing water sprayed from the fixed nozzles towards dishes accommodated in the basket, the vane being linearly reciprocated in the second direction; a guide rail for guiding a movement of the vane; and a control unit determining whether the vane is linearly reciprocated in the second direction in parallel with the first direction.

The vane may include a plurality of magnets provided at both sides thereof with respect to the guide rail and the washing tub may include a plurality of hall sensors provided therein for sensing the plurality of magnets.

The vane may include a first magnet provided at one end thereof with respect to the guide rail and a second magnet provided at the other end thereof, and the washing tub may include a first hall sensor for sensing the first magnet and a second hall sensor provided in the first direction from the first hall sensor for sensing the second magnet.

The control unit may determine that the vane is parallel to the first direction if the times on which the plurality of magnets are sensed, respectively, are identical to each other.

The plurality of magnets may include at least two magnets, one of which being spaced apart from the plurality of fixed nozzles by a distance which differs from a distance between the other and the plurality of fixed nozzles.

The control unit may determine that the vane is parallel to the first direction if a difference between the time on which one magnet is sensed and the time on which the other magnet is sensed is the same as a predetermined value, one magnet being spaced apart from the plurality of fixed nozzles by a distance which differs from a distance between the other magnet and the plurality of fixed nozzles.

The control unit may determine a moving direction of the vane on the basis of a sensing sequence of at least two magnets, one of the magnets being spaced apart from the plurality of fixed nozzles by a distance which differs from a distance between the other and the plurality of fixed nozzles.

The control unit may control the plurality of fixed nozzles to spray washing water at a predetermined pressure if the vane is not parallel to the first direction.

The plurality of fixed nozzles may spray washing water in the second direction which is perpendicular to the first direction.

In accordance with one aspect of an embodiment, a method for controlling a dishwashing machine including a plurality of fixed nozzles fixedly arranged in the first direction of a washing tub and spraying washing water in the second direction; and a vane which is provided for deflecting sprayed washing water to dishes accommodated in a basket and is linearly reciprocated in the second direction, may include sensing locations of both sides of the vane; on the basis of the sensing result of the vane, determining whether the vane is linearly reciprocated in the second direction in parallel with the first direction; and determining that the plurality of the fixed nozzles are clogged if the vane is not parallel to the first direction.

The process for sensing locations of both sides of the vane may include sensing a plurality of magnets provided at both sides of the vane by means of a plurality of hall sensors provided in the washing tub.

The process for determining whether the vane is parallel to the first direction may include determining that the vane is parallel to the first direction, if the plurality of magnets are simultaneously sensed.

The process for sensing locations of both sides of the vane may include sensing at least two magnets, one of which being spaced apart from the plurality of fixed nozzles by a distance which differs from a distance between the other and the plurality of fixed nozzles, of the plurality of magnets provided on the vane.

The process for determining whether the vane is parallel to the first direction may include determining whether the predetermined value is the same as a difference between the time on which one magnet is sensed and the time on which the other magnet is sensed, one magnet being spaced apart from the plurality of fixed nozzles by a distance which differs from a distance between the other magnet and the plurality of fixed nozzles.

The method according to one aspect of an embodiment may further include determining the moving direction of the vane on the basis of a sensing sequence of at least two magnets, one of which being spaced apart from the plurality of fixed nozzles by a distance which differs from a distance between the other and the plurality of fixed nozzles.

The method according to one aspect of an embodiment may further include spraying washing water at the predetermined pressure through the plurality of fixed nozzles if it is determined that the plurality of fixed nozzles are clogged.

The process for determining whether the vane is parallel to the first direction may include determining whether the vane is perpendicular to the second direction in which the vane is linearly reciprocated.

According to another embodiment, the dishwashing machine may include a main body; a washing tub provided in the main body; a basket provided in the washing tub for accommodating dishes; a plurality of fixed nozzles fixedly arranged in a first direction of the washing tub and spraying washing water in a second direction; a vane provided for deflecting washing water sprayed from the fixed nozzles towards dishes accommodated in the basket, the vane being linearly reciprocated in the second direction; a guide rail for guiding a movement of the vane; a pressure sensor provided on the vane for sensing a water pressure of washing water; and a control unit comparing the water pressure of washing water sensed by the pressure sensor with a predetermined value to determine whether the nozzle is clogged.

According to yet another embodiment, the dishwashing machine may include a main body; a washing tub provided in the main body; a basket provided in the washing tub for accommodating dishes; a plurality of fixed nozzles fixedly arranged in a first direction of the washing tub and spraying washing water in a second direction; a vane provided for deflecting washing water sprayed from the fixed nozzles towards dishes accommodated in the basket, the vane being linearly reciprocated in the second direction; a guide rail for guiding a movement of the vane; a vision sensor provided in the washing tub for sensing a spray trajectory of washing water; and a control unit comparing the spray trajectory of washing water sensed by the vision sensor with a predetermined trajectory to determine whether the nozzle is clogged.

According to further another embodiment, the dishwashing machine may include a main body; a washing tub provided in the main body; a basket provided in the washing tub for accommodating dishes; a plurality of fixed nozzles fixedly arranged in a first direction of the washing tub and spraying washing water in a second direction; a vane provided for deflecting washing water sprayed from the fixed nozzles towards dishes accommodated in the basket, the vane being linearly reciprocated in the second direction; a guide rail for guiding a movement of the vane; a plurality of flow meters provided at the plurality of fixed nozzles for sensing a flow rate of washing water; and a control unit comparing the flow rate of washing water sensed by the flow meters with a predetermined value to determine whether the nozzle is clogged.

BRIEF DESCRIPTION OF THE DRAWINGS

These and/or other aspects of embodiments will become apparent and more readily appreciated from the following description of the embodiments, taken in conjunction with the accompanying drawings of which.

DETAILED DESCRIPTION

Figure 1:
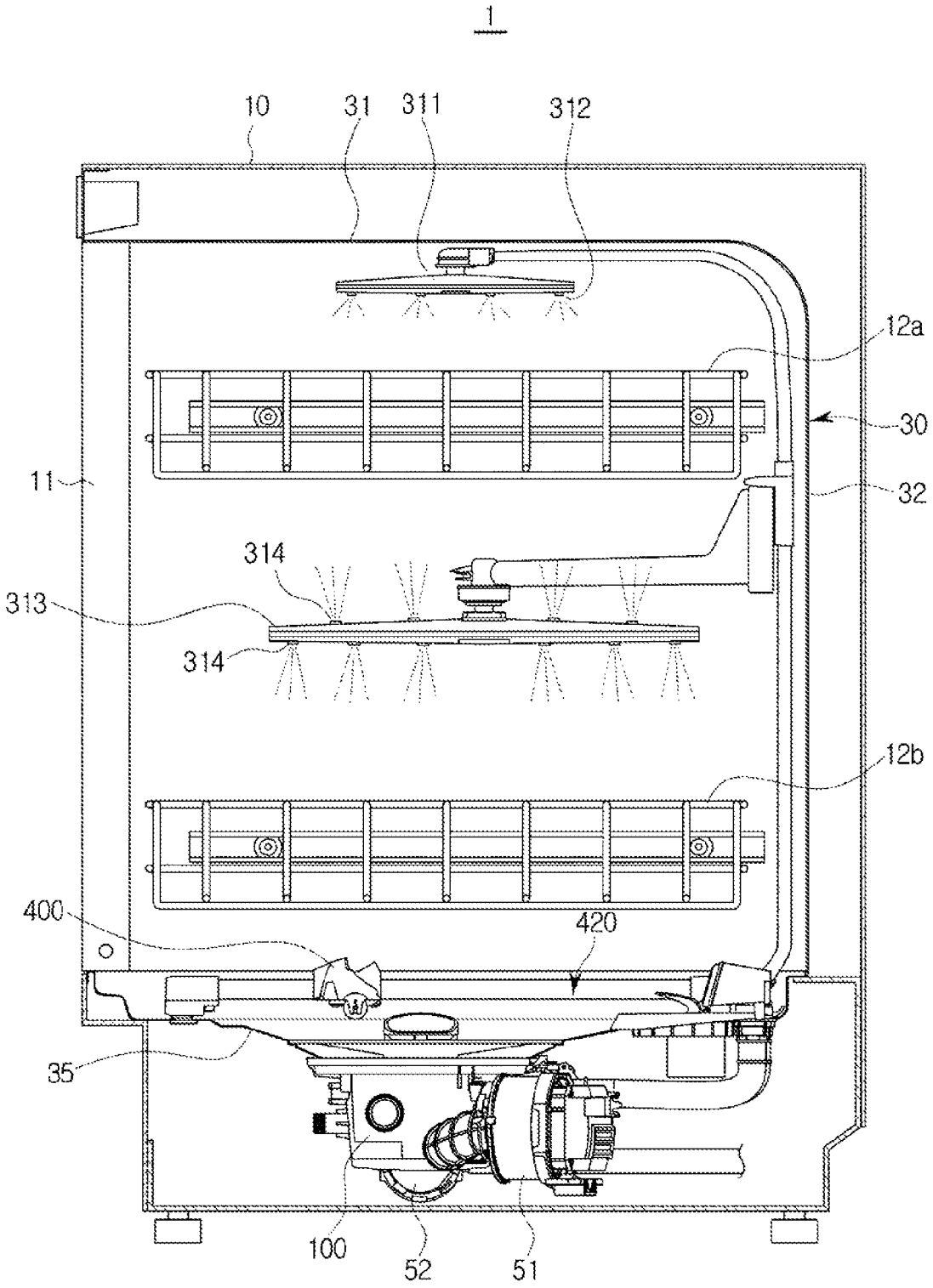
FIG. 1 is a schematic cross-sectional view of a dishwashing machine according to an embodiment.

Reference will now be made in detail to various embodiments of the present invention, examples of which are illustrated in the accompanying drawings, wherein like reference numerals refer to like elements throughout.

Figure 2:
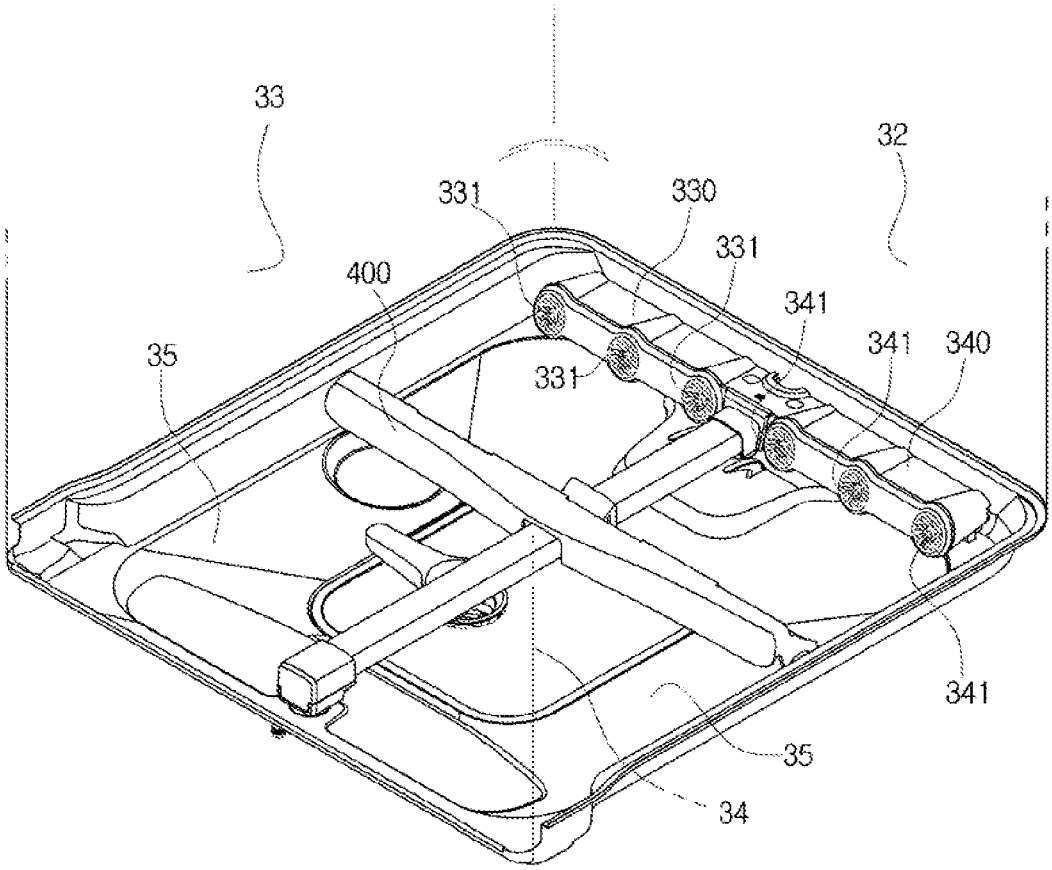
FIG. 2 is a view illustrating a lower portion of the dishwashing machine shown in FIG. 1.

FIG. 1 is a schematic cross-sectional view of a dishwashing machine according to an embodiment, and FIG. 2 is a view illustrating a lower portion of the dishwashing machine shown in FIG. 1.

Referring to FIG. 1 and FIG. 2, the overall structure of a dishwashing machine according to an embodiment is schematically described.

A dishwashing machine 1 includes a main body 10 forming an external appearance of the dishwashing machine, a washing tub 30 provided in the main body 10, baskets 12*a*, 12*b* provided in the washing tub 30 for accommodating dishes, a plurality of spray nozzles 311, 313, 330, and 340 for spraying washing water, a sump 100 for storing washing water, a circulation pump 51 for pumping washing water in the sump 100 and supplying washing water to the plurality of spray nozzles 311, 313, 330, and 340, a drain pump 52 for discharging washing water in the sump 100 together with dregs; a vane 400 which is moved in the washing tub 30 and deflects washing water to dishes, and a driving unit 420 for driving the vane 400.

The washing tub 30 may have an approximately box shape having an open front to allow dishes to be placed in or withdrawn from the washing tub. A front opening of the washing tub 30 may be opened/closed by a door 11. The washing tub 30 may have an upper wall 31, a rear wall 32, a left side wall 33, a right side wall 34, and a bottom plate 35.

The baskets 12*a* and 12*b* may be a wire rack consisting of wires to enable washing water to be drained without collecting washing water. The baskets 12*a* and 12*b* may be attachably/detachably provided in the washing tub. The baskets 12*a* and 12*b* may include an upper basket 12*a* disposed at an upper portion of the washing tub 30 and a lower basket 12*b* disposed at a lower portion of the washing tub 30.

The plurality of spray nozzles 311, 313, 330, and 340 may spray washing water at a high pressure to wash dishes. The plurality of spray nozzles 311, 313, 330, and 340 may include an upper rotary nozzle 311 provided at an upper portion of the washing tub 30, an intermediate rotary nozzle 313 provided at a central portion of the washing tub 30, and a plurality of fixed nozzles 330 and 340 provided at a lower portion of the washing tub 30.

The upper rotary nozzle 311 is provided at an upper side of the upper basket 12*a*, and this rotary nozzle can be rotated by a water pressure and spray washing water in the downward direction. To attain this end, spray holes 312 may be provided at a lower end of the upper rotary nozzle 311. The upper rotary nozzle 311 can spray washing water directly to dishes accommodated in the upper basket 12*a*.

The intermediate rotary nozzle 313 is provided between the upper basket 12*a* and the lower basket 12*b* and at a central portion of the washing tub 30, and this nozzle is rotated by a water pressure and can spray washing water in the upward/downward direction. To attain this end, spray holes 314 may be provided at a lower end and an upper end of the intermediate rotary nozzle 313. The intermediate rotary nozzle 313 can spray washing water directly to dishes accommodated in the upper basket 12*a* and the lower basket 12*b*.

Unlike the rotary nozzles 311 and 313, the plurality of fixed nozzles 330 and 340 are maintained in a stationary state and fixed to one side of the washing tub 30. The plurality of fixed nozzles 330 and 340 are disposed at a place which is approximately adjacent to the rear wall 32 of the washing tub 30 and can spray washing water to a front portion of the washing tub 30. Thus, washing water sprayed from the plurality of fixed nozzles 330 and 340 may not be directed to dishes.

Washing water sprayed from the plurality of fixed nozzles 330 and 340 may be deflected towards dishes by the vane 400. The plurality of fixed nozzles 330 and 340 are disposed under the lower basket 12*b*, and the vane 400 may deflect washing water sprayed from the plurality of fixed nozzles 330 and 340 in the upward direction. By means of the vane 400, in other words, washing water sprayed from the plurality of fixed nozzles 330 and 340 may be deflected toward dishes accommodated in the lower basket 12*b*.

The plurality of fixed nozzles 330 and 340 may have a plurality of spray holes 331 and 341, respectively, these spray holes being arranged in the left and right directions of the washing tub 30. The plurality of spray holes 331 and 341 may spray washing water towards the front portion.

The vane 400 may be extended in the left and right directions of the washing tub 30 to enable all washing water sprayed from the plurality of spray holes 331 and 341 of the plurality of fixed nozzles 330 and 340 to be deflected. In other words, the vane 400 may be provided such that one longitudinal end of the vane 400 is adjacent to the left side wall 33 of the washing tub 30 and the other longitudinal end of the vane 400 is adjacent to the right side wall 34 of the washing tub 30.

The above vane 400 may be linearly reciprocated along the spraying direction of washing water sprayed from the plurality of fixed nozzles 330 and 340. In other words, the vane 400 may be linearly reciprocated in the forward/rearward direction of the washing tub 30.

Thus, the linear spray structure including the plurality of fixed nozzles 330 and 340 and the vane 400 can wash the overall region of the washing tub 30 without a blind spot. This differs from the structure in which the rotary nozzles can spray washing water only within a range of a radius of rotation of the rotary nozzle.

Up to now, a schematic structure of the dishwashing machine is described with reference to FIG. 1 and FIG. 2. Hereinafter, a stroke, a flow channel structure, a structure of the fixed nozzle, and a washing water distributing structure of the dishwashing machine according to an embodiment are described with reference to FIG. 3 to FIG. 5.

Figure 3:
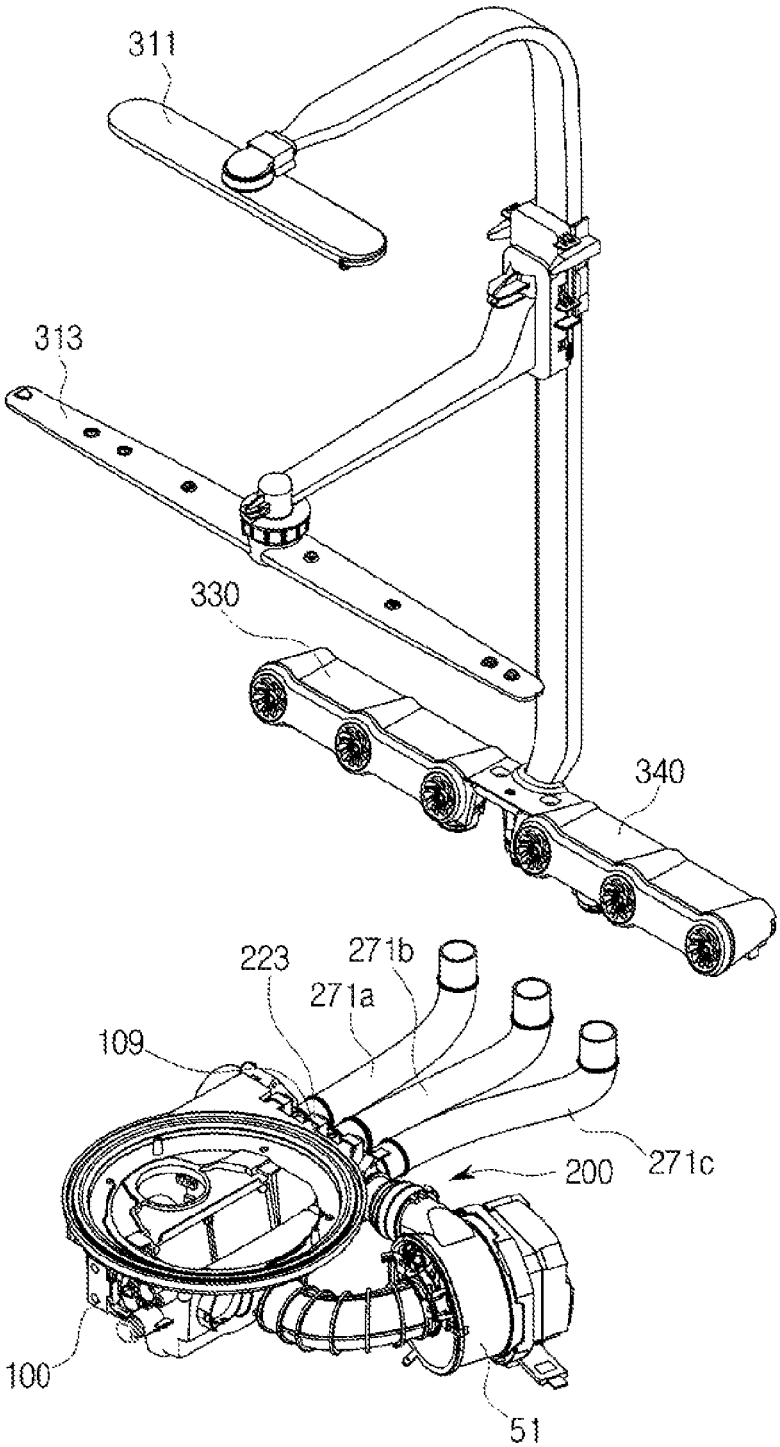
FIG. 3 is a view illustrating a flow channel structure of the dishwashing machine shown in FIG. 1.
Figure 4:
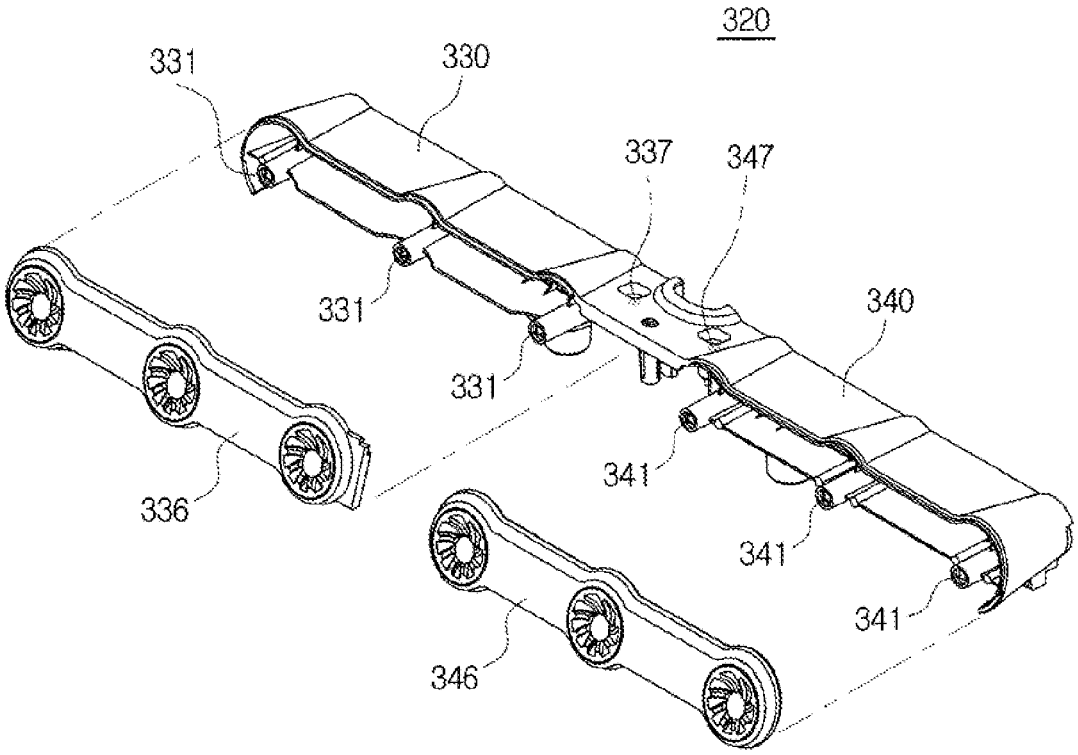
FIG. 4 is an exploded view illustrating a fixed nozzle assembly of the dishwashing machine shown in FIG. 1.
Figure 5:
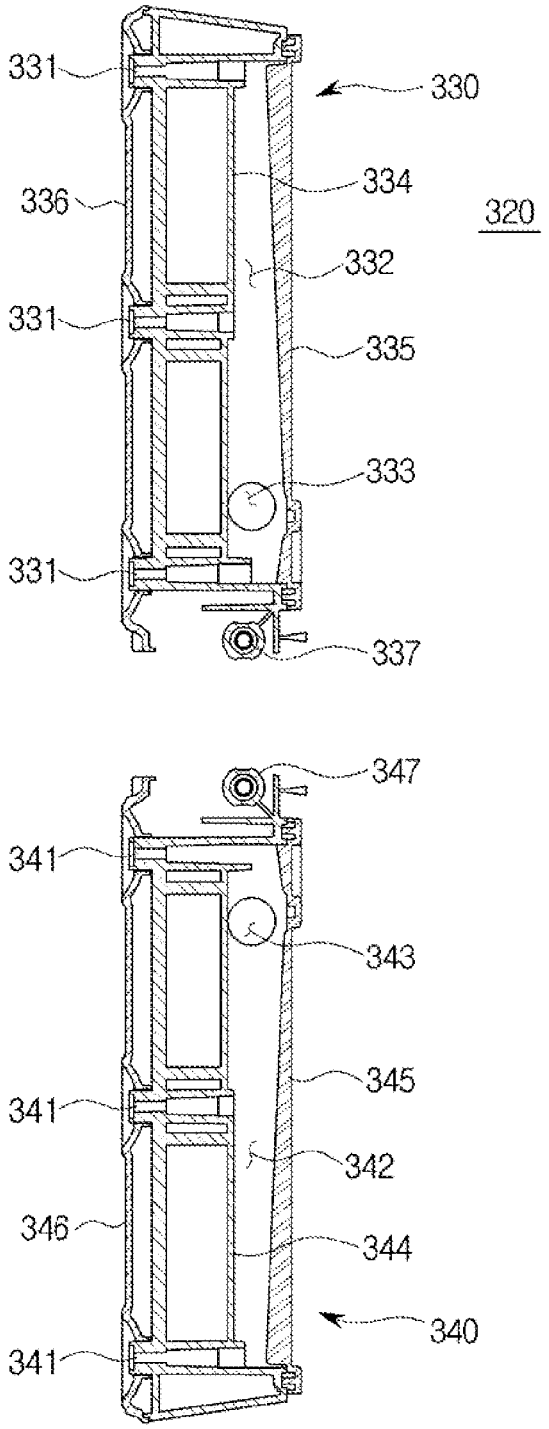
FIG. 5 is a cross-sectional view illustrating a fixed nozzle assembly of the dishwashing machine shown in FIG. 1.

FIG. 3 is a view illustrating a flow channel structure of the dishwashing machine shown in FIG. 1, FIG. 4 is an exploded view illustrating a fixed nozzle assembly of the dishwashing machine shown in FIG. 1, and FIG. 5 is a cross-sectional view illustrating the fixed nozzle assembly of the dishwashing machine shown in FIG. 1.

The dishwashing machine may have a water-supplying stroke, a washing stroke, a water-draining stroke, and a drying stroke.

In the water-supplying stroke, washing water can be supplied into the washing tub 30 via a water-supplying pipe (not shown). Washing water supplied to the washing tub 30 may flow to the sump 100 provided at a lower portion of the washing tub 30 by means of a gradient of the bottom plate 35 of the washing tub 30 and may be then stored in the sump 100.

In the washing stroke, the circulation pump 51 may be operated to pump washing water in the sump 100. Washing water pumped by the circulation pump 51 may be distributed to the rotary nozzles 311 and 313, the left fixed nozzle 330 and the right fixed nozzle 340 through a distribution device 200. By a pumping force of the circulation pump 51, washing water may be sprayed from the plurality of spray nozzles 311, 313, 330, and 340 at a high pressure to wash dishes.

Here, the upper rotary nozzle 311 and the intermediate rotary nozzle 313 may be supplied with washing water from the distribution device 200 via a second hose 271*b*. The left fixed nozzle 330 may be supplied with washing water from the distribution device 200 via a first hose 271*a*. The right fixed nozzle 340 may be supplied with washing water from the distribution device 200 via a third hose 271*c*.

According to an embodiment of the dishwashing machine, the distribution device 200 may be designed to have three (3) distribution modes in total.

In the first mode, the distribution device 200 supplies washing water to only the rotary nozzles 311 and 313 through the second hose 271*b*.

In the second mode, the distribution device 200 supplies washing water to only the right fixed nozzle 340 through the third hose 271*c*.

In the third mode, the distribution device 200 supplies washing water to only the plurality of fixed nozzles 330 and 340 through the first hose 271*a* and the third hose 271*c*.

It goes without saying that, unlike this embodiment constructed as above, the distribution device 200 may be designed to have more variety of distribution modes.

Washing water sprayed from the plurality of spray nozzles 311, 313, 330, and 340 may strike dishes to remove dregs from the dishes, may be fallen together with dregs and stored in the sump 100 again.

The circulation pump 51 pumps washing water stored in the sump 100 again and circulate the washing water. In the washing stroke, an operation and a halt of the circulation pump 51 may be repeated several times. In this process, dregs fallen down with washing water is collected by a filter mounted to the sump 100 and remained in the sump 100 without being circulated into the plurality of spray nozzles 311, 313, 330, and 340.

In the water-draining stroke, the drain pump 52 can may operated to enable dregs and washing water remained in the sump 100 to be discharged to an outside.

In the drying stroke, a heater (not shown) mounted to the washing tub 30 may be operated to dry dishes.

A structure of each of the left fixed nozzle 330 and the right fixed nozzle 340 is described in detail.

The left fixed nozzle 330 may include the spray holes 331 for spraying washing water, a nozzle flow channel 332 for supplying washing water to the spray holes 331, a nozzle inlet 333 for entering washing water to the nozzle flow channel 332, a nozzle body 334 forming an external appearance, a nozzle cover 335 coupled to a rear portion of the nozzle body 334 to form the nozzle flow channel 332, an ornamental member 336 coupled to a front portion of the nozzle body 334, and a coupling hole 337 formed on the nozzle body 334 to allow the left fixed nozzle 330 to be secured to a bottom plate cover which will be described later.

The right fixed nozzle 340 may include the spray holes 341 for spraying washing water, a nozzle flow channel 342 for supplying washing water to the spray holes 341, a nozzle inlet 343 for entering washing water to the nozzle flow channel 342, a nozzle body 344 forming an external appearance, a nozzle cover 345 coupled to a rear portion of the nozzle body 344 to form the nozzle flow channel 342, an ornamental member 346 coupled to a front portion of the nozzle body 344, and a coupling hole 347 formed on the nozzle body 344 to allow the right fixed nozzle 340 to be secured to the bottom plate cover 600 which will be described later.

Here, the nozzle body 334 of the left fixed nozzle 330 may be formed integrally with the nozzle body 344 of the right fixed nozzle 340. Therefore, the left fixed nozzle 330 may be formed integrally with the right fixed nozzle 340.

Since the left fixed nozzle 330 is formed integrally with the right fixed nozzle 340 as above, a horizontal alignment of the left fixed nozzle 330 and the right fixed nozzle 340 may be easily achieved, and the left fixed nozzle 330 and the right fixed nozzle 340 can be easily coupled to the bottom plate cover 600.

In order to secure an excellent washing force of the dishwashing machine, the nozzle must spray a desired amount of high-pressure washing water. At this time, a pressure and flow rate of washing water to be sprayed may be determined in advance at the time of manufacturing the dishwashing machine. Unlike the above, the pressure and flow rate of washing water can be determined by a separate input entered by a user.

However, if the nozzle is clogged by foreign substances, washing water supplied from the sump may not be sprayed at a desired pressure or with a desired flow rate. In particular, if dregs removed from dishes by washing water are moved into the nozzle along with washing water, dregs may be caught in the nozzle inlet 333, 343, the nozzle flow channel 332, 342, or the spray holes 331, 341. Dregs remained in the nozzle blocks partially washing water sprayed to an outside through the spray holes 331, 341. Consequently, washing water is not sprayed at a desired pressure or with a desired flow rate so that a washing force of the dishwashing machine is lowered.

In order to solve the above problem, the dishwashing machine can determine whether the plurality of fixed nozzles 330 and 340 are clogged.

Figure 6:
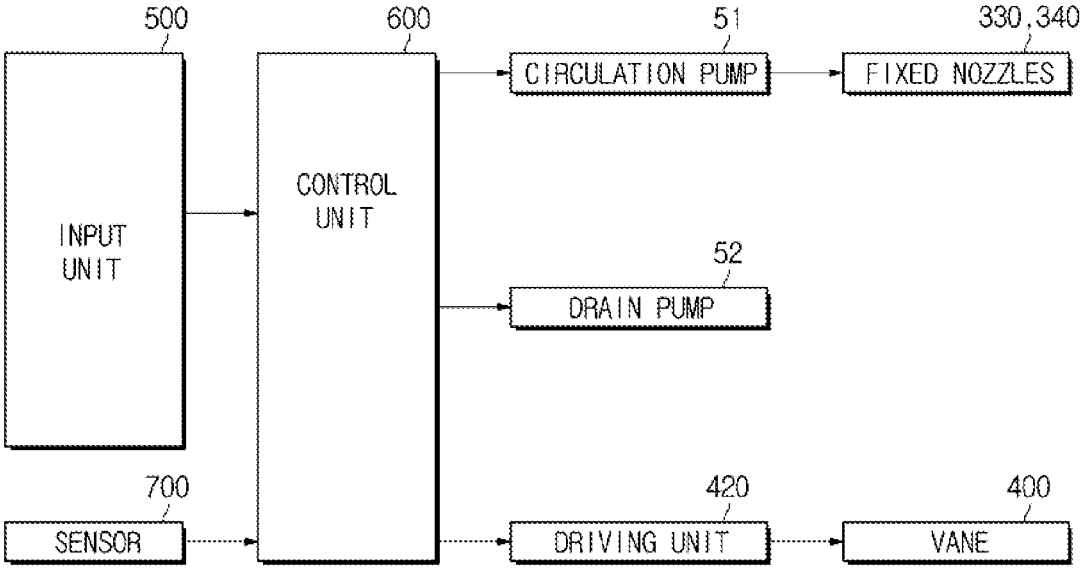
FIG. 6 is a control block diagram of a dishwashing machine in accordance with an embodiment.

FIG. 6 is a control block diagram of the dishwashing machine according to an embodiment, which can determine whether the nozzle is clogged or not.

A user may input the data regarding the operation information, such as a washing course (for example, a standard course, a manual course, and the like), a temperature of washing water, an addition of rinse, and the like, to an input unit 500. The entered input is transmitted to a control unit 600 (i.e., a controller) so that the dishwashing machine may be controlled according to the input. The control unit 600 may include, for example, a computer processor and a memory to perform various operations described herein. For example, a computer processor in control unit 600 may execute instructions stored in the memory to perform various operations described herein.

In addition, a user may input the data, such as the pressure of washing water, a flow rate of washing water, a path of washing water in the normal state in which there is no clogging in the plurality of fixed nozzles 330 and 340, to the input unit 500. The above input may be utilized as the information for determining whether the plurality of fixed nozzles 330 and 340 are clogged or not. A detail thereon will be described later.

A sensor 700 can transmit the information, which can be utilized for determining whether the plurality of fixed nozzles 330 and 340 are clogged or not, to the control unit 600. The sensor 700 may include a hall sensor 710 for sensing a magnet, a pressure sensor 720, or a vision sensor 730. However, embodiments are not limited thereto. A method for determining, by utilizing the sensor 700, whether the plurality of fixed nozzles 330 and 340 are clogged is described later.

The control unit 600 can control the dishwashing machine according to the input entered by the user. More concretely, the control unit 600 controls the dishwashing machine such that the circulation pump 51 is operated to allow washing water to be sprayed from the plurality of fixed nozzles 330 and 340. In addition, the control unit 600 can operate the drain pump 52 to discharge washing water, which is stored in the sump 100 after completing a washing process, to an outside of the main body 10. Furthermore, the control unit 600 can drive the driving unit 420 to allow the vane 400 to be linearly reciprocated along the direction in which washing water is sprayed.

In order to determine whether the plurality of fixed nozzles 330 and 340 are clogged, furthermore, the control unit 600 may determine whether the vane 400 is linearly reciprocated in parallel with the plurality of fixed nozzles 330 and 340. This function is described with reference to FIG. 7*a* and FIG. 7*b*.

Figure 7A:
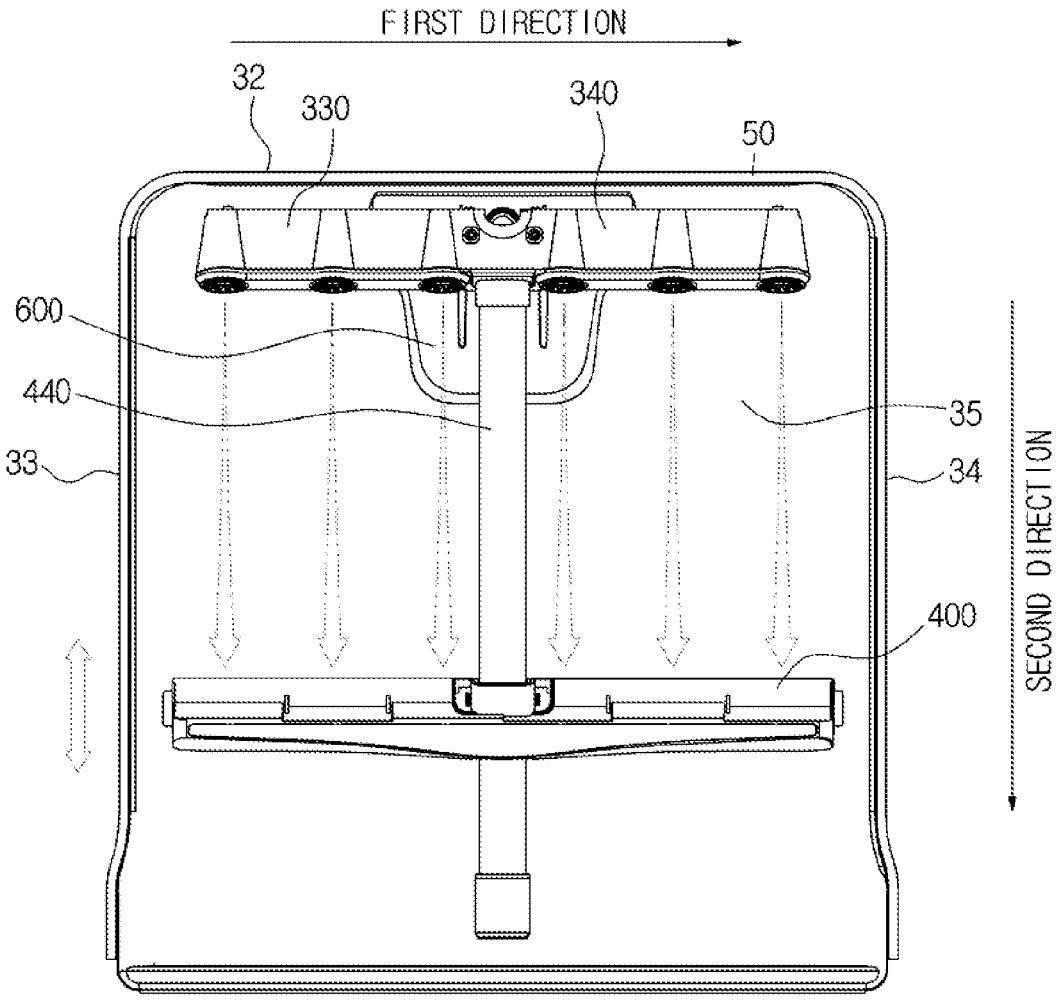
FIG. 7*a* and FIG. 7*b* are views for describing a location of a vane according to clogging of a nozzle.
Figure 7B:
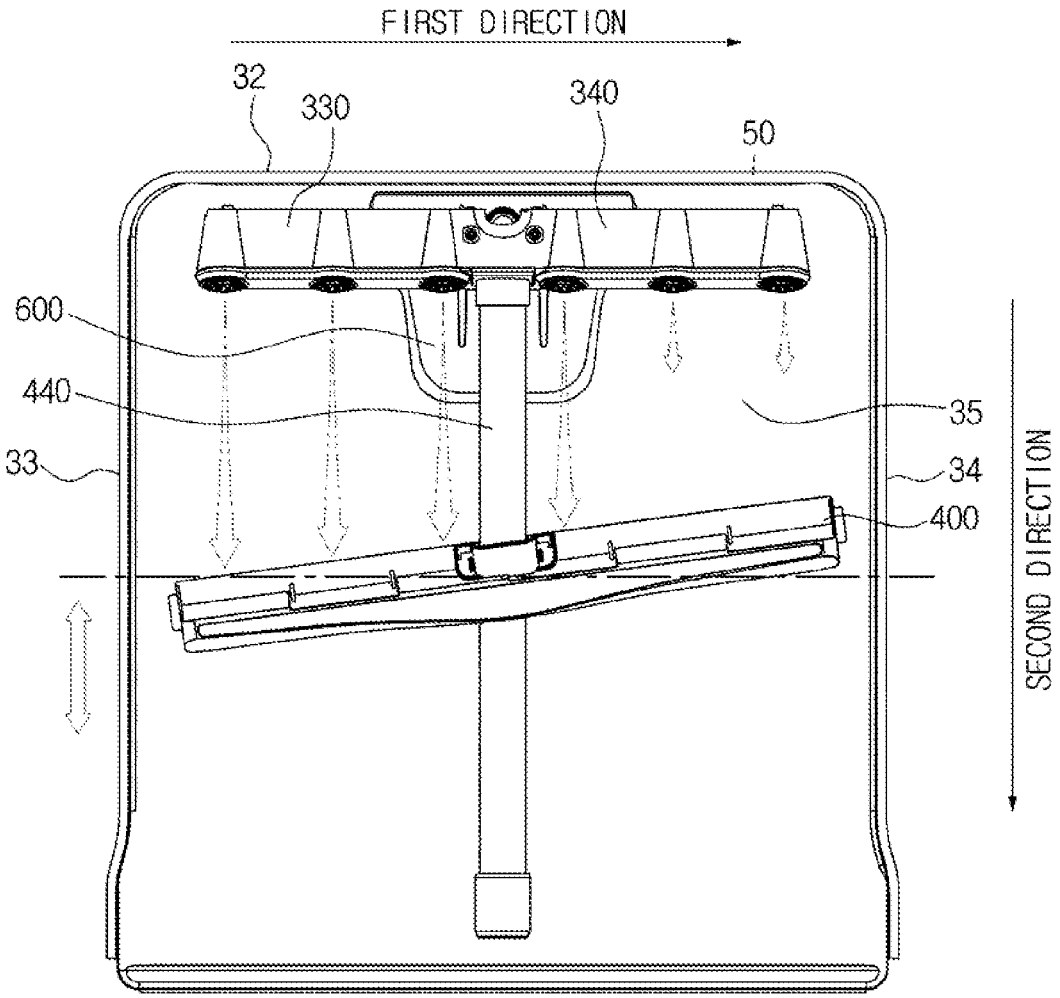

FIG. 7*a* and FIG. 7*b* are views for describing a location of the vane according to a clogging of the plurality of fixed nozzles 330 and 340.

FIG. 7*a* shows exemplarily a normal state in which the plurality of fixed nozzles 330 and 340 are not clogged. In a case where washing water is sprayed from the spray holes 331 and 341 at the same water pressure, the pressure applied to a right part of the vane 400 with respect to a guide rail 440 is the same as the pressure applied to a left part of the vane 400 with respect to the guide rail. Without inclining to any one side, therefore, the vane 400 is linearly reciprocated in parallel with the direction in which the spray holes 331 and 341 are arranged.

FIG. 7*b* shows that some of the plurality of fixed nozzles 330 and 340 is clogged. If two (2) spray holes 341 of six (6) spray holes 331 and 341 are clogged as shown in FIG. 7*b*, the pressures or flow rates of washing water sprayed through the spray holes 331 and 341 may differ from each other depending on the spray holes. Therefore, the pressure applied to the right part of the vane 400 may be less than that applied to the left part of the vane. As a result, the vane 400 is inclined to the left side.

Like this, the control unit 600 determines whether the direction in which the spray holes 331 and 341 are arranged is parallel to the location at which the vane 400 is placed, that is, whether the vane 400 is inclined in any one direction, to any one side and then can determine whether the plurality of fixed nozzles 330 and 340 are clogged on the basis of the above determination.

In order to determine whether the direction in which the spray holes 331 and 341 are arranged is parallel to the location at which the vane 400 is placed, the control unit 600 may determine locations of both sides of the vane 400. To attain this end, a magnet and a hall sensor may be employed.

More concretely, as an example, magnets may be provided at both ends of the vane 400. In addition, when the vane 400 is linearly reciprocated along the guide rail, a plurality of hall sensors may be provided on paths along which the both ends of the vane 400 are moved. According to an embodiment of the dishwashing machine, as an example, a first magnet 810 may be provided at a left end of the vane 400 and a second magnet 820 may be provided at a right end of the vane 400. In addition, as an example, in order to sense the first magnet 810, a first hall sensor 711 may be provided at a moving path of the first magnet 810 on the bottom plate 35 of the washing tub. Similarly, as an example, in order to sense the second magnet 820, a second hall sensor 712 may be provided at a moving path of the second magnet 820 on the bottom plate 35 of the washing tub. As an example, the first hall sensor 711 and the second hall sensor 712 may be spaced apart from the plurality of fixed nozzles 330 and 340, respectively, by the same distance.

Figure 8A:
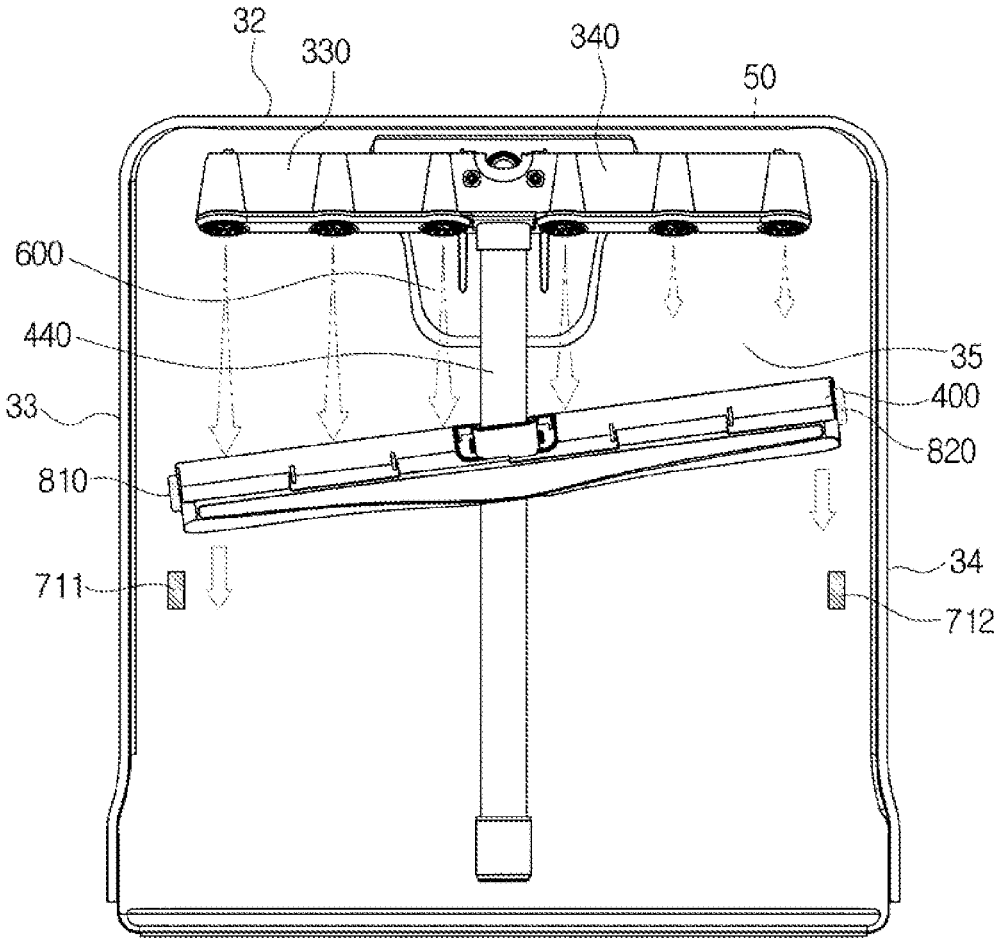
FIG. 8*a* to FIG. 8*c* are views for describing a method for determining locations of both sides of a vane utilizing a magnet and a hall sensor in accordance with an embodiment.
Figure 8B:
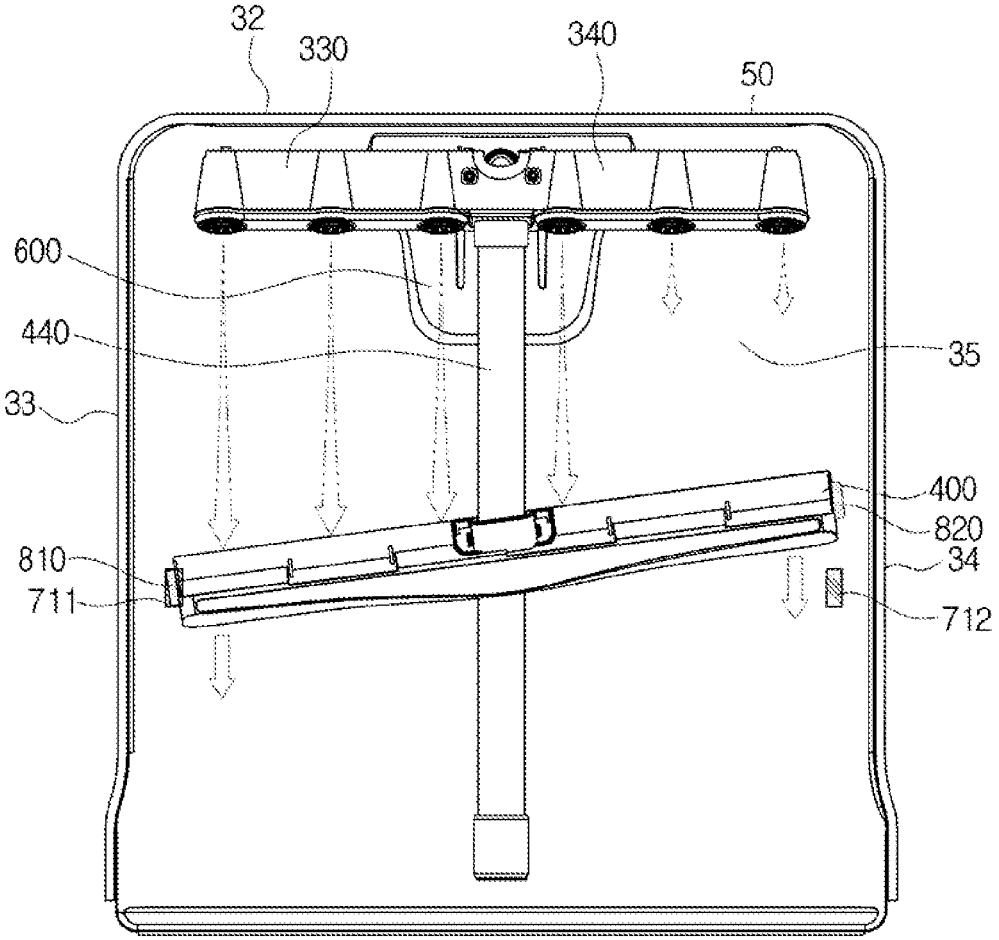
Figure 8C:
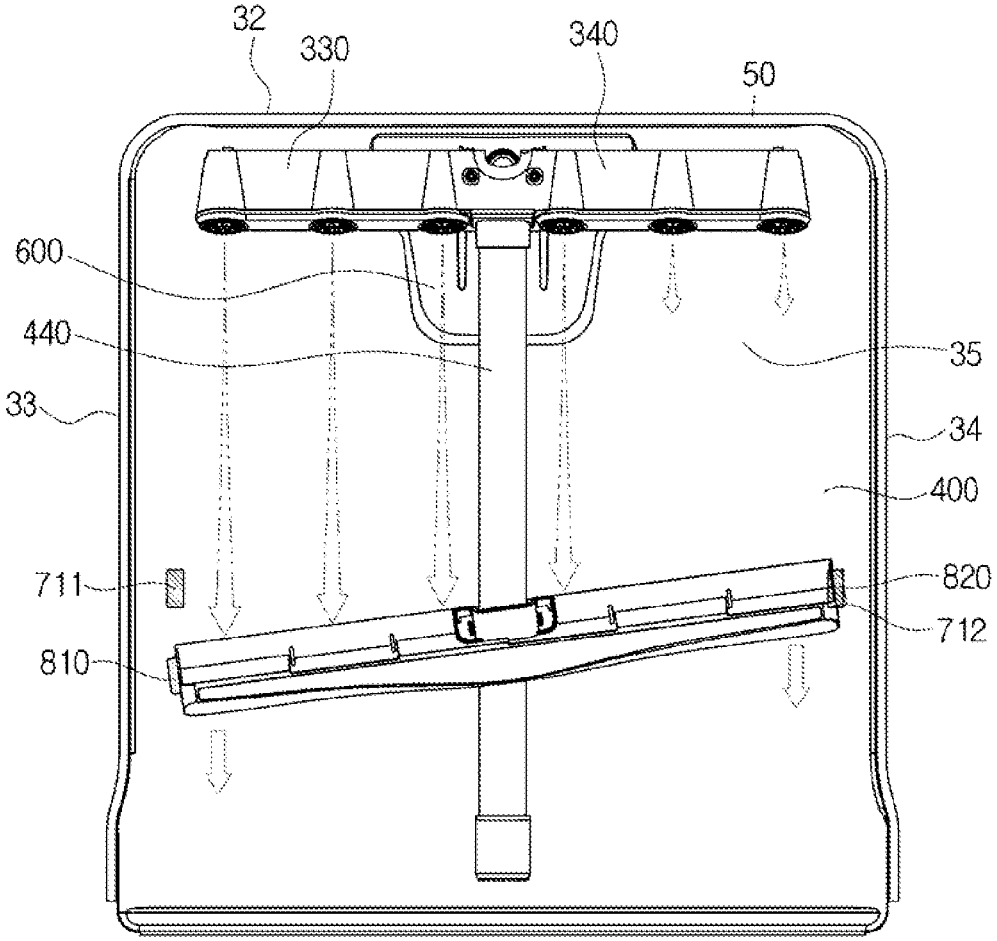

FIG. 8*a* to FIG. 8*c* are views for describing an embodiment of a method for determining locations of both sides of the vane utilizing the magnet and hall sensor. Hereinafter, the method is described on the assumption that the vane 400 is inclined to a left side.

Referring to FIG. 8*a*, in the state where the vane 400 is inclined to the left side, the vane is linearly moved to the front portion of the washing tub 30. The first magnet 810 and the second magnet 820 are provided at the left side and right side of the vane 400, respectively. In addition, the first hall sensor 711 sensing the first magnet 810 and the second hall sensor 712 sensing the second magnet 820 are provided on the bottom plate 35 of the washing tub.

As shown in FIG. 8*b*, as the vane 400 is moved to the front portion of the washing tub 30, the first magnet 810 may be sensed by the first hall sensor 711. Since the vane 400 is inclined to the left side, the first magnet 810 is sensed before sensing the second magnet 820.

If the vane 400 is further moved to the front portion of the washing tub 30 as time passes, the second magnet 820 may be sensed by the second hall sensor 712 as shown in FIG. 8*c*. Like this, if the vane 400 is inclined in any one direction, there is a difference between the time on which the first magnet 810 is sensed and the time on which the second magnet 820 is sensed.

Therefore, if the time on which the first magnet 810 is sensed differs from the time on which the second magnet 820 is sensed, this means that the vane 400 is inclined in any one direction. This may mean that the plurality of fixed nozzles 330 and 340 are clogged.

In a case where the direction in which the spray holes 331 and 341 are arranged and the location on which the vane 400 is placed are not parallel to each other, the control unit 600 may control an operation performed for solving a clogging of the plurality of fixed nozzles 330 and 340.

More concretely, the control unit 600 may control the plurality of fixed nozzles 330 and 340 so as to allow high-pressure washing water to be sprayed.

Here, the high pressure employed for solving a clogging of the plurality of fixed nozzles 330 and 340 means the pressure of washing water by which foreign substances remaining in the plurality of fixed nozzles 330 and 340 can be discharged to an outside. The above pressure may be determined in advance at the time of manufacturing the dishwashing machine and may be also determined in advance by a separate input entered by a user.

Once high-pressure washing water is introduced into the plurality of fixed nozzles 330 and 340, foreign substances in the plurality of fixed nozzles 330 and 340 can be discharged to an outside by the pressure of washing water together with washing water. Due to the above, a clogging of the plurality of fixed nozzles 330 and 340 can be solved.

Figure 9:
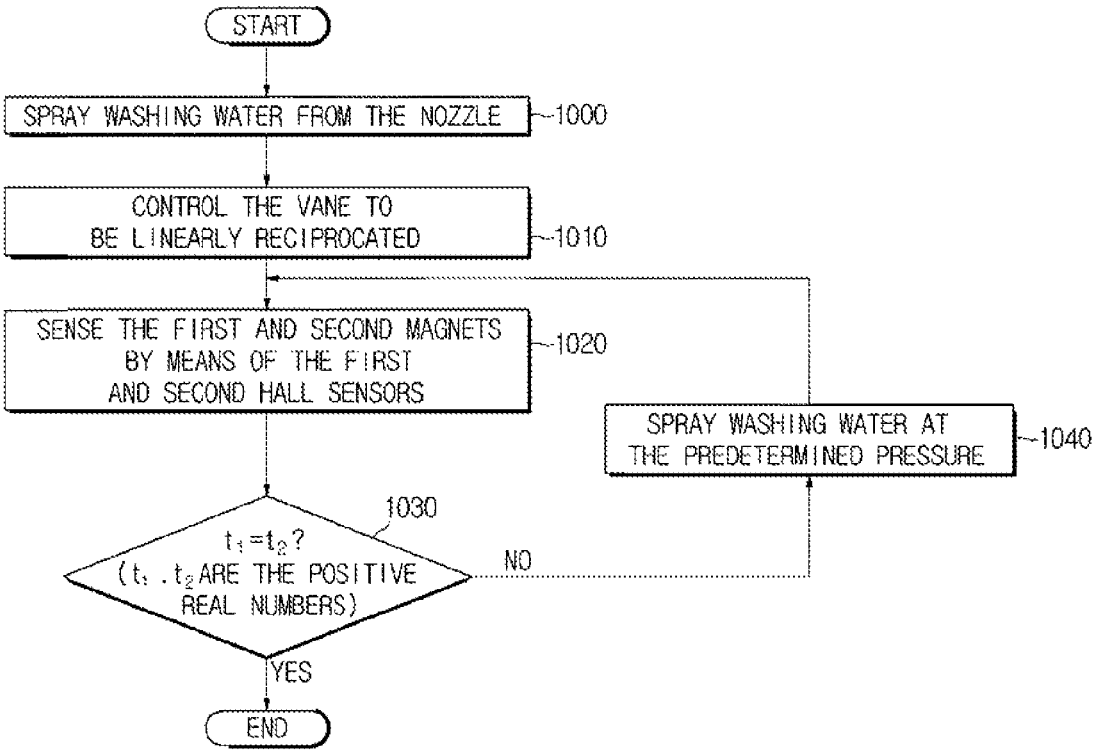
FIG. 9 is a flowchart for describing a method for controlling a dishwashing machine in accordance with an embodiment.

FIG. 9 is a flowchart for describing an embodiment of the method for controlling the dishwashing machine.

First of all, washing waster is sprayed from the plurality of fixed nozzles 330 and 340 (1000). The rotary nozzles 311 and 313 spray washing water to dishes to directly remove dregs, but the plurality of fixed nozzles 330 and 340 spray washing water to the vane 400. The vane 400 can deflect washing water to dishes to remove dregs from the dishes.

If washing water is deflected to the vane which is in a stationary state, only a specific region of dishes is washed by deflected washing water. Therefore, the control unit 600 controls the vane 400 to be linearly reciprocated (1010). The vane 400 is moved to the front and rear portions of the washing tub 30 by a guidance of the guide rail. Therefore, the entire region of the washing tub 30 can be washed.

During the linear reciprocation of the vane, the first and second magnets provided on the vane are sensed by the first and second hall sensors (1020). To attain this end, the first magnet 810 may be provided at one end of the vane 400 and the second magnet 820 may be provided at the other end of the vane 400. In addition, the first hall sensor 711 may be provided at a moving path of the first magnet 810 on the bottom plate 35 of the washing tub. Similarly, the second hall sensor 712 may be provided at a moving path of the second magnet 820 on the bottom plate 35 of the washing tub. In particular, the first hall sensor 711 and the second hall sensor 712 may be spaced apart from the plurality of fixed nozzles 330 and 340, respectively, by the same distance.

If the time on which the first magnet is sensed by the first hall sensor is called t1, and the time on which the second magnet is sensed by the second hall sensor is called t2, the control unit 600 determines whether t1 is the same as t2 (1030). If t1 is the same as t2, this means that the vane 400 is not inclined and is linearly reciprocated in parallel with the direction in which the plurality of fixed nozzles 330 and 340 are arranged. In other words, the plurality of fixed nozzles 330 and 340 can spray washing water at a desired pressure and with a desired flow rate.

On the contrary, if t1 differs from t2, this means that the vane 400 is inclined to any one direction. This is caused by a difference between the pressure/flow rate of washing water sprayed from the spray hole 331 and the pressure/flow rate of washing water sprayed from the spray hole 341. Since this may mean that the plurality of fixed nozzles 330 and 340 are clogged, the step for curing the problem may be carried out.

More concretely, washing water may be sprayed at a predetermined pressure (1040). At this time, the predetermined pressure means the pressure of washing water by which foreign substances remaining in the plurality of fixed nozzles 330 and 340 can be discharged to an outside. The above predetermined pressure may be determined in advance at the time of manufacturing the dishwashing machine and may be also determined in advance by a separate input entered by a user.

After spraying washing water at the predetermined pressure, the first magnet 810 and the second magnet 820 are sensed again. If the time on which the first magnet 810 is sensed is the same as the time on which the second magnet 820 is sensed, this means that a clogging of the plurality of fixed nozzles 330 and 340 is solved. Thus, a normal washing process for dishes can be carried out. On the contrary, if the time on which the first magnet 810 is sensed still differs from the time on which the second magnet 820 is sensed, washing water may be sprayed at the predetermined pressure for curing a clogging of the plurality of fixed nozzles 330 and 340.

At this time, washing water can be sprayed once or several times.

In the process shown in FIG. 9, the control unit 600 determines whether the plurality of fixed nozzles 330 and 340 are clogged or not, and always sprays washing water at the predetermined pressure for curing a clogging of the plurality of fixed nozzles 330 and 340 if the plurality of fixed nozzles 330 and 340 are clogged. Unlike the above, however, if a clogging of the plurality of fixed nozzles 330 and 340 is not cured, the control unit 600 may inform the user that the plurality of fixed nozzles 330 and 340 need to be cleaned.

More concretely, if it is determined that the plurality of fixed nozzles 330 and 340 are clogged, the control unit 600 sprays washing water at the predetermined pressure and determines again whether the plurality of fixed nozzles 330 and 340 are clogged. If, despite a repetition of the above process, it is determined that the plurality of fixed nozzles 330 and 340 are clogged, the dishwashing machine can generate an error signal to inform the user that the nozzles need to be cleaned. At this time, the number of repetition of process for spraying washing water at the predetermined pressure can be determined in advance at the time of manufacturing the dishwashing machine or determined by a separate input entered by a user. In addition, the error signal may include a halt of all operations of the dishwashing machine by the control unit 600, a display of an error image on a display unit, or a generation of an alarm sound.

FIG. 8*a* to FIG. 8*c* and FIG. 9 show exemplarily the structure in which the first magnet 810 and the second magnet 820 are provided on the same places of the left portion ad the right portion of the vane 400. Unlike the above structure, however, a structure, in which a distance between the plurality of fixed nozzles 330 and 340 and a third magnet 830 differs from a distance between the plurality of fixed nozzles 330 and 340 and a fourth magnet 840, may be provided.

Figure 10A:
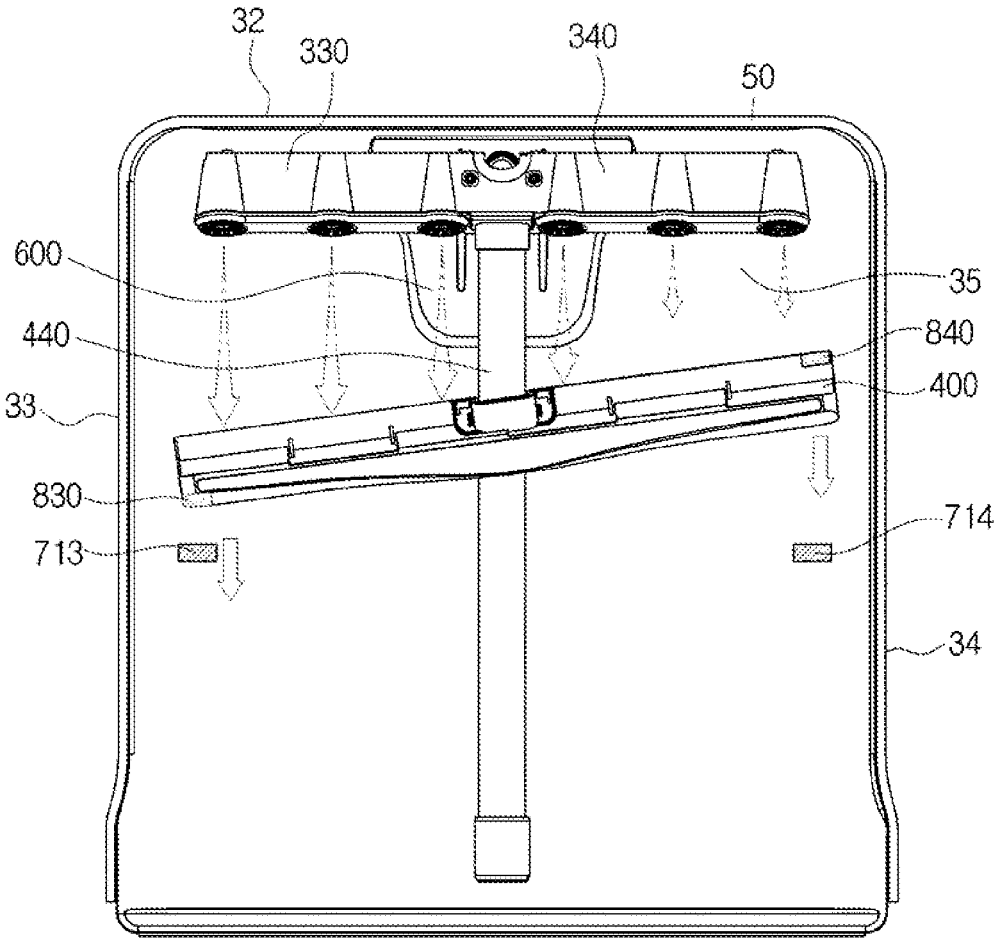
FIG. 10*a* to FIG. 10*c* are views for describing a method for determining locations of both sides of a vane utilizing a magnet and a hall sensor in accordance with another embodiment.
Figure 10B:
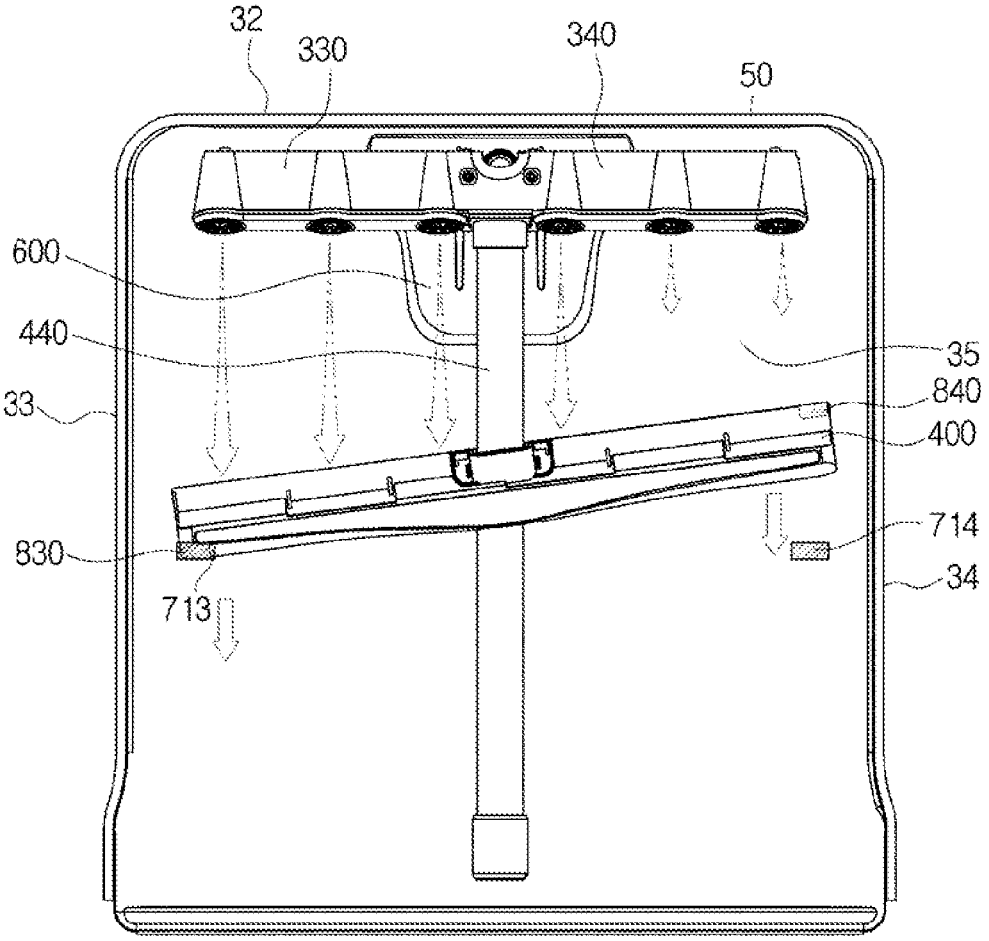
Figure 10C:
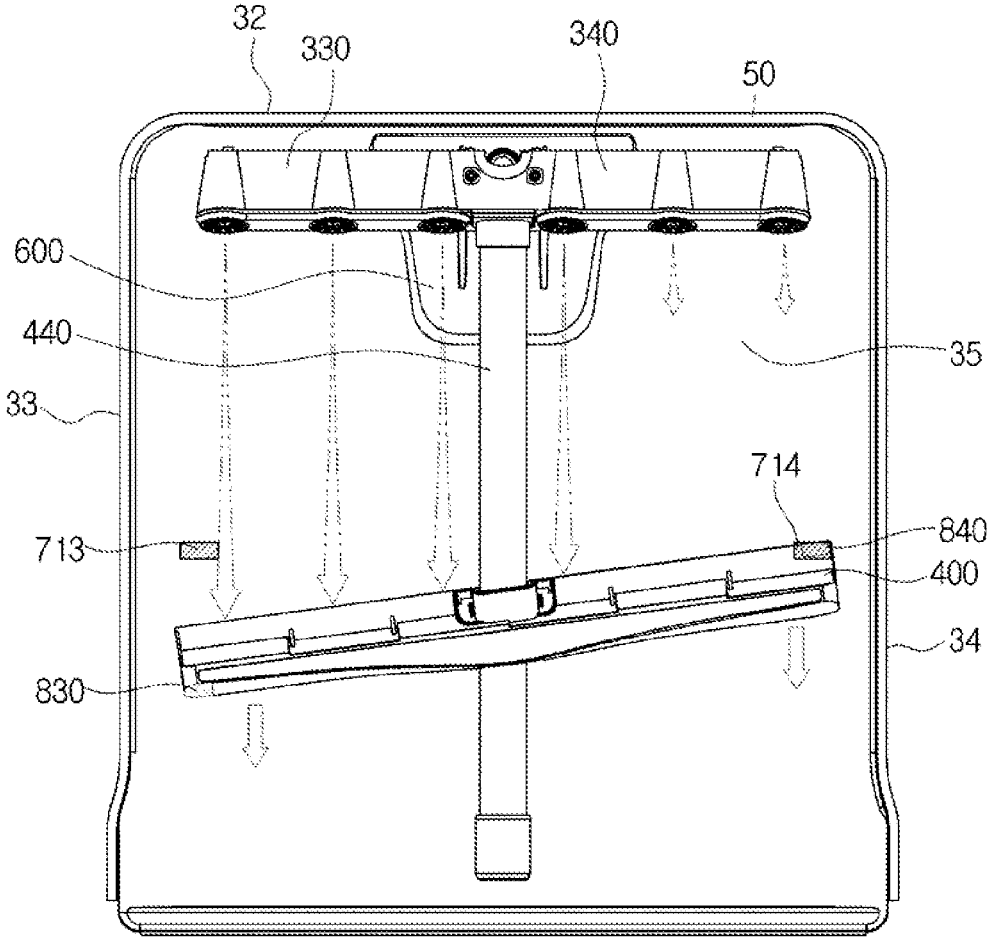

FIG. 10*a* to FIG. 10*c* are views for describing another embodiment of a method for determining locations of both sides of the vane 400 utilizing the magnet and hall sensor. Hereinafter, the method is described under the assumption that the vane 400 is inclined to a left side.

Referring to FIG. 10*a* to FIG. 10*c*, the third magnet 830 is provided at a location which is far from the plurality of fixed nozzles 330 and 340, i.e., a location which is near to a front side of the washing tub 30. Meanwhile, the fourth magnet 840 is provided at a location which is near to the plurality of fixed nozzles 330 and 340, i.e., a location which is near to a rear side of the washing tub 30.

In the structure shown in FIG. 10*a* to FIG. 10, like the structure shown in FIG. 8*a* to FIG. 8*c*, the fourth magnet 840 is sensed after sensing the third magnet 830. However, since the location of the vane 400, on which the third magnet 830 is provided, differs from the location on the vane 400, on which the fourth magnet 840 is provided, from the beginning, an inclination of the vane 400 should be determined in consideration of this condition.

Hereinafter, a method for determining whether the plurality of fixed nozzles 330 and 340 are clogged and solving a clogging of the plurality of fixed nozzles 330 and 340, when the locations of the magnets provided on the vane 400 differ from each other, is described with reference to FIG. 11.

Figure 11:
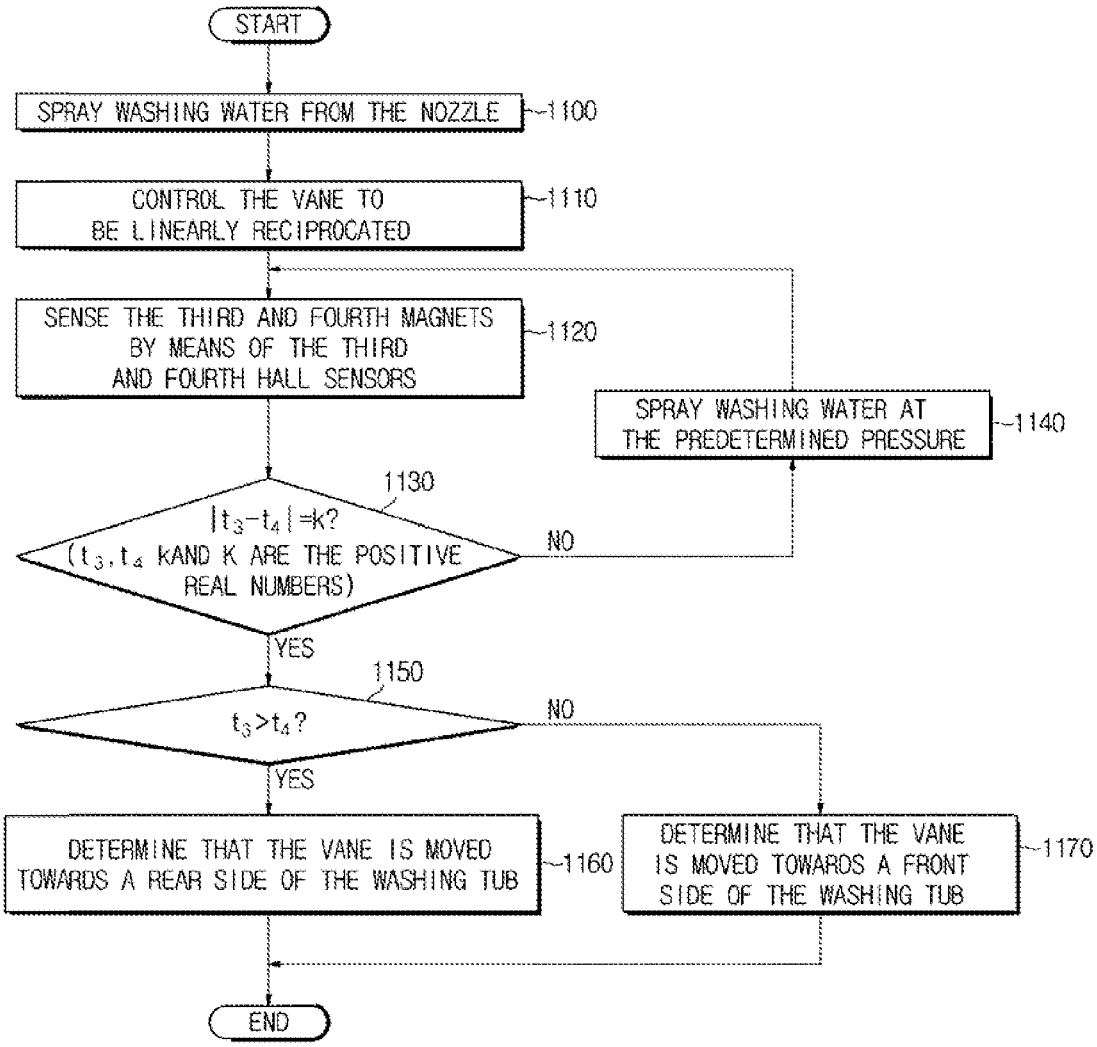
FIG. 11 is a flowchart for describing a method for controlling a dishwashing machine in accordance with another embodiment.

FIG. 11 is a flowchart for describing another embodiment of the method for controlling the dishwashing machine.

First of all, washing waster is sprayed from the plurality of fixed nozzles (1100). In response to the above, the control unit 600 controls the vane so that the vane is linearly reciprocated (1110). Washing water sprayed from the plurality of fixed nozzles 330 and 340 may be deflected towards dishes by the vane 400 to perform a washing process for dishes.

During the linear reciprocation of the vane, the third and fourth magnets provided on the vane are sensed by a third hall sensor 713 and a fourth hall sensor 714 (1120). To attain this end, the third magnet 830 may be provided at a point of one end of the vane 400, which is near to the front side of the washing tub 30, and the fourth magnet 840 may be provided at a point of the other end of the vane 400, which is near to the rear side of washing tub 30.

In addition, the third hall sensor 713 may be provided at a moving path of the third magnet 830 on the bottom plate 35 of the washing tub. Similarly, the fourth hall sensor 714 may be provided at a moving path of the fourth magnet 840 on the bottom plate 35 of the washing tub. The third hall sensor 713 may be provided at a location at which the first hall sensor 711 of FIG. 9 is provided, and the fourth hall sensor 714 may be provided at a location at which the second hall sensor 712 of FIG. 9 is provided.

If the time on which the third magnet is sensed by the third hall sensor is called t3, and the time on which the fourth magnet is sensed by the fourth hall sensor is called t4, the control unit 600 determines whether an absolute value of a difference between t3 and t4 is the same as a predetermined K (1130).

Here, the K means a difference between the time on which the third magnet 830 is sensed and the time on which the fourth magnet 840 is sensed, when the vane is linearly reciprocated in a state where the vane 400 is not inclined. In consideration of a moving speed of the vane 400 and the locations at which the third magnet 830 and the fourth magnet 840 are provided, at this time, the K may be predetermined.

If the absolute value of the difference between t3 and t4 is the same as the predetermined K, this means that the vane 400 is not inclined and is linearly reciprocated in parallel with the direction in which the plurality of fixed nozzles 330 and 340 are arranged. Accordingly, a clogging of the plurality of fixed nozzles 330 and 340 is not generated.

On the contrary, if the absolute value of the difference between t3 and t4 differs from the predetermined K, this means that the vane 400 is inclined to any one direction. Since this means that the plurality of fixed nozzles 330 and 340 are clogged and washing water is not sprayed normally, the step for curing the problem may be carried out.

Spraying washing water at the predetermined pressure (1140) to solve a clogging of the plurality of fixed nozzles is the same as that described with reference to FIG. 9.

If, despite a repetition of the above process, it is determined that the plurality of fixed nozzles 330 and 340 are clogged, the dishwashing machine can generate an error signal to inform the user that the nozzles need to be cleaned.

After washing water is sprayed at the predetermined pressure, the control unit 600 determines again whether the plurality of fixed nozzles 330 and 340 are clogged. If it is determined again that the plurality of fixed nozzles 330 and 340 are clogged, the next step for solving a clogging is carried out.

In addition, if the plurality of fixed nozzles 330 and 340 are not clogged, a moving direction of the vane 400 may be determined. To attain this end, it should be determined whether t3 is larger than t4.

More concretely, if t3 is larger than t4, it means that the fourth magnet 840 is sensed before sensing the third magnet 830. Therefore, it can be determined that the vane 400 is moved to a point which is near to the plurality of fixed nozzles 330 and 340, that is, is moved toward the rear side of the washing tub 30.

On the contrary, if t4 is larger than t3, it means that the third magnet 830 is sensed before sensing the fourth magnet 840. Therefore, it can determined that the vane 400 is moved to a point which is opposite to the plurality of fixed nozzles 330 and 340, that is, is moved toward the front side of the washing tub 30.

Although FIG. 11 illustrates that the moving direction of the vane 400 is determined after a clogging of the plurality fixed nozzles 330 and 340 is solved, a clogging of the plurality fixed nozzles 330 and 340 may be solved after the moving direction of the vane 400 is determined or the above two steps may be simultaneously carried out.

In the above, as the method for determining whether the plurality of fixed nozzles 330 and 340 are clogged, the method in which the control unit 600 determines whether the vane 400 is linearly reciprocated in parallel with the plurality of fixed nozzles 330 and 340 is described. Unlike the above method, however, it is possible to determine whether the plurality of fixed nozzles 330 and 340 are clogged, by sensing the water pressure of washing water.

Figure 12:
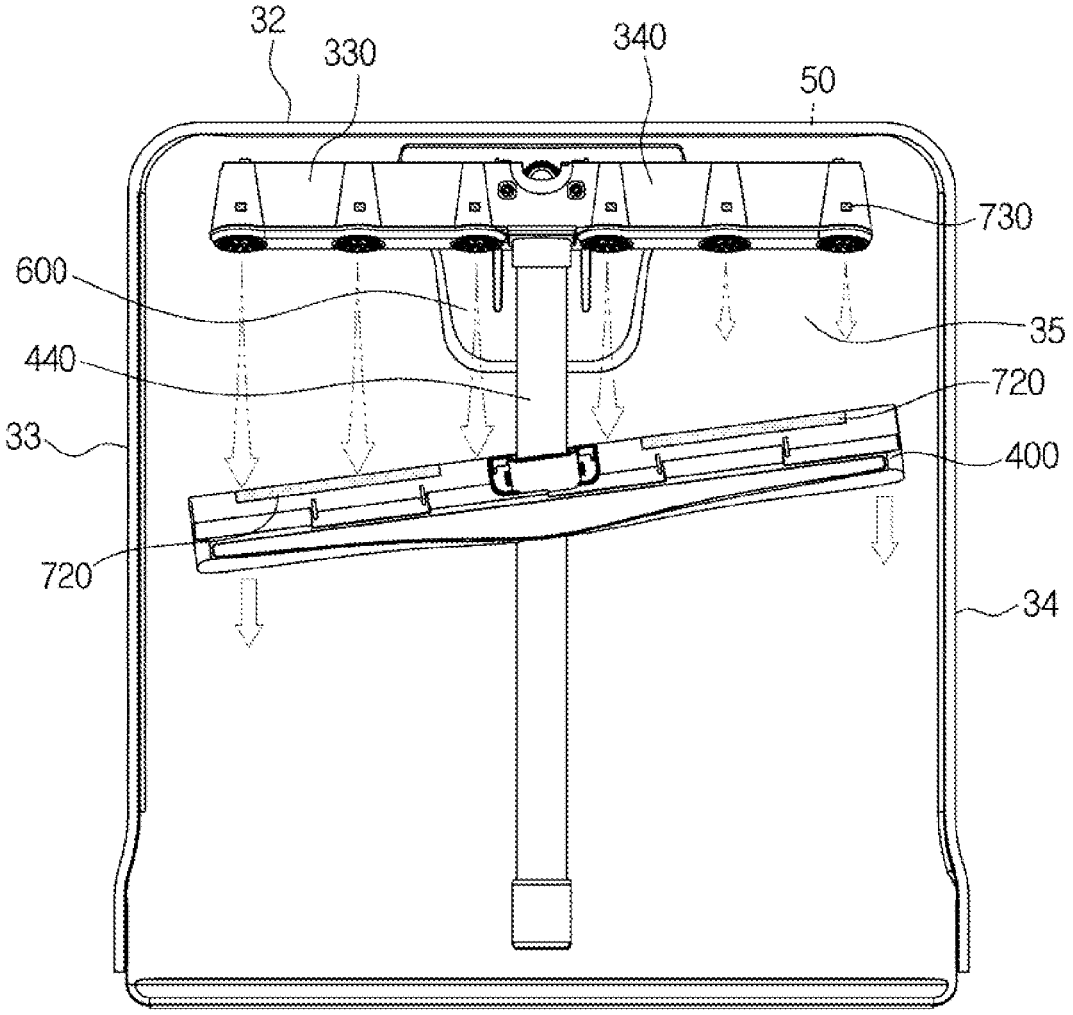
FIG. 12 is a view illustrating a method for determining whether a fixed nozzle is clogged utilizing a pressure sensor in accordance with an embodiment.

FIG. 12 is a view for describing an embodiment of the method for determining whether the plurality of fixed nozzles 330 and 340 are clogged, by utilizing the pressure sensor 720. Although FIG. 12 exemplarily shows that two pressure sensors 720 are provided, the number of the pressure sensor 720 is not limited.

As previously mentioned, if the plurality of fixed nozzles 330 and 340 are clogged, the pressure of washing water which is being sprayed may be reduced. Therefore, by sensing the pressure of washing water and comparing this sensed pressure with the pressure of washing water which is sprayed when the plurality of fixed nozzles 330 and 340 are not clogged, it is possible to determine whether the plurality of fixed nozzles 330 and 340 are clogged.

To attain this end, the pressure sensor 720 may be provided on the vane 400. The pressure sensor 720 provided as above senses the pressure of sprayed washing water. On the basis of the information on the sensed pressure, the control unit 600 can determine whether the plurality of fixed nozzles 330 and 340 are clogged.

In particular, if the pressure sensor 720 senses the pressure of only some of washing water, it is difficult to determine whether all the fixed nozzles 330 and 340 are clogged. Therefore, the pressure sensor 720 may have a sensing area to enable the pressure of all washing water sprayed to the vane 400 to be sensed.

If the right spray holes 341 are clogged as described with reference to FIG. 12, the pressure sensed by the pressure sensor 720 provided at a right side of the vane 400 is lower than the pressure of washing water sprayed from the left spray holes 331 which are not clogged. By means of this pressure difference, it is possible to determine whether the plurality of fixed nozzles 330 and 340 are clogged.

Figure 13:
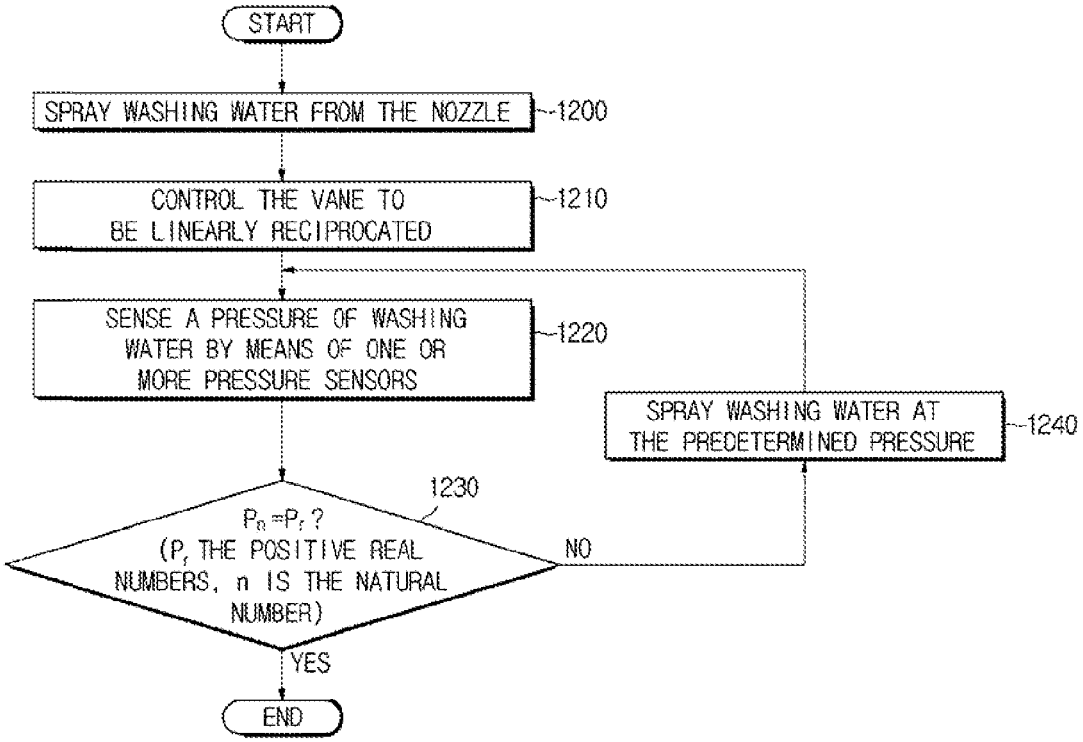
FIG. 13 is a flowchart for describing a method for controlling a dishwashing machine in accordance with yet another embodiment.

FIG. 13 is a flowchart for describing yet another embodiment of the method for controlling the dishwashing machine.

Like FIG. 9, washing water is sprayed from the plurality of fixed nozzles (1200). In addition, the vane is linearly reciprocated to deflect washing water to dishes (1210).

At this time, at least one or more pressure sensors provided on the vane can sense the pressure of washing water which is being sprayed (1220). A sensing area and the number of the pressure sensors 720 may be determined so that the pressure sensor can sense the pressure of overall washing water which is being sprayed.

If the pressure sensed by any one of at least one or more pressure sensors is called P1, the control unit 600 determines whether P1 is the same as Pr (1230). At this time, Pr means the pressure of washing waster sprayed from the plurality of fixed nozzles 330 and 340 which are not clogged.

In addition, if the pressure sensed by another pressure sensor, which is not the pressure sensor previously mentioned, is called P2, the control unit 600 determines whether P2 is the same as Pr. If n-multiple pressure sensors 720 are provided, the control unit 600 determines whether the pressures sensed by all the pressure sensors 720 are the same as Pr.

As a result of determination, if any one of the pressures sensed by the plurality of pressure sensors 720 differs from Pr, this means that the plurality of fixed nozzles 330 and 340 are clogged. Therefore, the step for solving a clogging of the plurality of fixed nozzles 330 and 340 is carried out.

Spraying washing water at the predetermined pressure (1240) to solve a clogging of the plurality of fixed nozzles is the same as that described with reference to FIG. 9.

In addition, if, despite a repetition of the above process, it is determined that the plurality of fixed nozzles 330 and 340 are clogged, the dishwashing machine can generate an error signal to inform the user that the nozzles need to be cleaned.

Unlike the methods described above, the control unit 600 may determine, on the basis of a spray trajectory of sprayed washing water, whether the plurality of fixed nozzles 330 and 340 are clogged.

Due to a clogging of the nozzle, the pressure and flow rate of washing water may be changed and a spray trajectory of sprayed washing water may be also changed. Therefore, if washing water having a spray trajectory, which differs from that of washing water sprayed from the plurality of fixed nozzles 330 and 340 which are not clogged, is sensed, it is possible to determine that the plurality of fixed nozzles 330 and 340 are clogged.

The vision sensor 730 may be employed for sensing the spray trajectory of washing water, and the vision sensor 730 may be provided at all the places at which the spray trajectory of washing water can be sensed.

Determining whether the plurality of fixed nozzles 330 and 340 are clogged through the vision sensor 730 and solving a clogging of the nozzle are performed in the method which is similar to that employing the pressure sensor 720. Therefore, the detail description thereon is omitted.

On the basis of a flow rate of sprayed washing water, the control unit 600 may determine whether the plurality of fixed nozzles 330 and 340 are clogged or not. To attain this end, the dishwashing machine may include a flow meter 900. In this case, unlike the structure shown in FIG. 6, a plurality of flow meters 900 may be utilized instead of the sensor 700.

Figure 14:
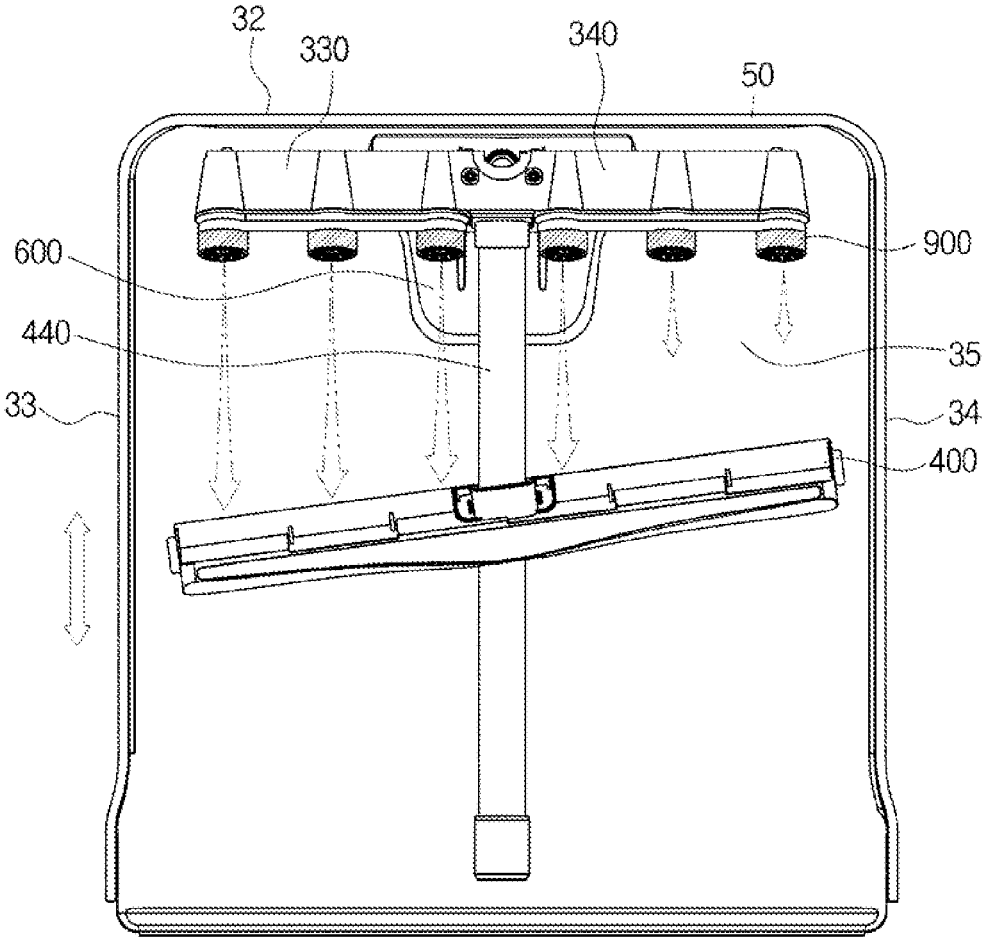
FIG. 14 is a view illustrating a method for determining whether a fixed nozzle is clogged utilizing a flow meter in accordance with an embodiment.

FIG. 14 is a view for describing an embodiment of the method for determining whether the plurality of fixed nozzles 330 and 340 are clogged through the flow meter.

As previously mentioned, if the nozzle is clogged, the flow rate as well as the pressure of washing water are changed. Therefore, by comparing with a flow rate of washing water when the nozzle is not clogged, it is possible to determine whether the nozzle is clogged.

Referring to FIG. 14, the flow meter 900 may be provided at each of the spray holes 331 and 341. The flow meters 900 sense the flow rate of washing water sprayed from the spray holes 331 and 341, and, on the basis of the data transmitted from the flow meters 900, the control unit 600 may determine whether the plurality of fixed nozzles 330 and 340 are clogged.

However, the above structure is merely an embodiment of the dishwashing machine employing the flow meter 900. If the flow meter can sense the flow rate of sprayed washing water, the location at which the flow meter 900 is provided is not limited.

Figure 15:
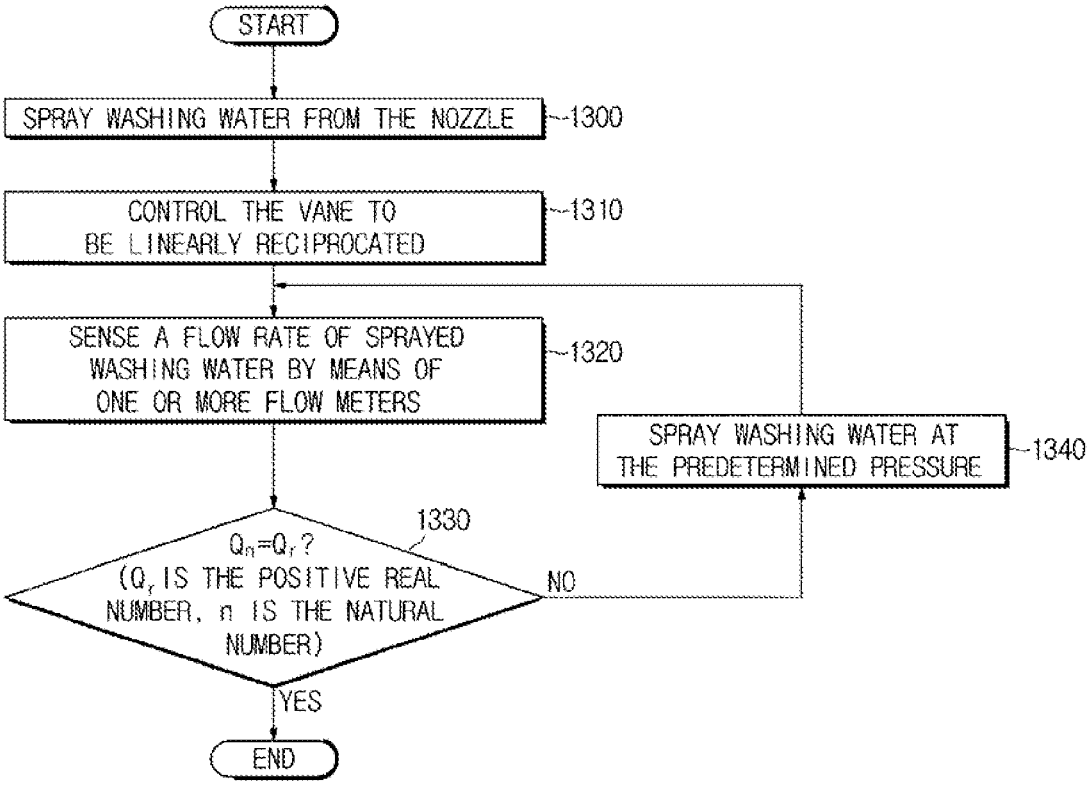
FIG. 15 is a flowchart for describing a method for controlling a dishwashing machine in accordance with further another embodiment.

FIG. 15 is a flowchart for describing further another embodiment of the method for controlling the dishwashing machine.

Like the methods illustrated in FIG. 9 and FIG. 13, washing water is sprayed from the plurality of fixed nozzles (1300), and sprayed washing water can be deflected to dishes by the vane (1310).

At this time, the flow meters 900 can sense the flow rate of washing water sprayed from the plurality of fixed nozzles (1320). Like the example shown in FIG. 14, if the flow meters 900 are provided at all six (6) spray holes 331 and 341, six (6) flow rates of washing water can be sensed.

If the flow rate sensed by each flow meter is called Qn (n is the natural number), the control unit 600 compares Qn with Qr (1330). At this time, Qr means the flow rate of washing water sprayed from the plurality of fixed nozzles 330 and 340 which are not clogged.

If the flow rates sensed from all the flow meters 900 are the same as Qr, respectively, the step for solving a clogging of the nozzle is not performed.

However, if any one of the flow meters 900 senses the flow rate which differs from Qr, the control unit 600 determine that the nozzle is clogged. In this case, the step for solving a clogging of the nozzle may be performed.

In order to solve a clogging of the nozzle, washing water is sprayed at the predetermined pressure (1340) as illustrated with reference to FIG. 9.

If, despite a repetition of the above process, it is determined that the plurality of fixed nozzles 330 and 340 are clogged, the dishwashing machine can generate an error signal to inform the user that the nozzles need to be cleaned.

According to one aspect of the dishwashing machine and the method for controlling the same, it is possible to determine whether the nozzle is clogged and to automatically determine whether the dishwashing machine has the problems. In addition, the process for improving a clogging of the nozzle can be automatically carried out to improve a washing defect of the dishwashing machine. Even if the process for improving the washing defect is repeatedly performed, if a clogging problem of the nozzle is not solved, the dishwashing machine can generate an error signal to inform the user that the nozzles need to be cleaned.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dishwashing machine, comprising;

a main body;

a washing tub provided in the main body;

a basket provided in the washing tub to accommodate dishes;

a plurality of fixed nozzles fixedly arranged in a first direction of the washing tub to spray washing water in a second direction;

a vane being linearly reciprocatable in the second direction while the plurality of fixed nozzles are spraying the washing water, to deflect the sprayed washing water towards dishes accommodated in the basket, wherein, when a pressure applied to the vane by the sprayed washing water is even, the vane linearly reciprocates in parallel with the first direction and, when the pressure applied to the vane by the sprayed washing water is not even, the vane linearly reciprocates at an incline to the first direction and is thereby not in parallel with the first direction; and a controller configured to determine whether the vane is linearly reciprocating in the second direction in parallel with the first direction.

2. The dishwashing machine according to claim 1, wherein the vane includes first and second sides opposite to each other, the dishwashing machine further comprising:

at least one magnet provided at each of the first and second sides of the vane, and hall sensors provided on the washing tub to sense said at least one magnet provided at each of the first and second sides of the vane, wherein the controller uses the hall sensors sensing of said at least one magnet to determine whether the vane is linearly reciprocating in the second direction in parallel with the first direction.

3. The dishwashing machine according to claim 2, wherein said at least one magnet provided at each of the first and second sides of the vane include a first magnet provided at the first side and a second magnet provided at the second side, and the hall sensors include a first hall sensor to sense the first magnet and a second hall sensor provided in the first direction from the first hall sensor to sense the second magnet.

4. The dishwashing machine according to claim 2, wherein the controller determines that the vane is parallel with the first direction if times at which said at least one magnet provided at each of the first and second sides of the vane are sensed, respectively, are identical to each other.

5. The dishwashing machine according to claim 2, wherein said at least one magnet provided on each of the first and second sides of the vane include first and second magnets, one magnet of the first and second magnets being positioned on the first side of the vane, the other magnet of the first and second magnets being positioned on the second side of the vane, and said one magnet being spaced apart from the plurality of fixed nozzles by a distance which differs from a distance between said other magnet and the plurality of fixed nozzles.

6. The dishwashing machine according to claim 5, wherein the controller determines that the vane is parallel with the first direction if a difference between a time at which the first magnet is sensed and a time on which the second magnet is sensed is the same as a predetermined value.

7. The dishwashing machine according to claim 5, wherein the controller determines a moving direction of the vane on the basis of a sensing sequence of the first and second magnets.

8. The dishwashing machine according to claim 1, wherein the controller controls the plurality of fixed nozzles to spray washing water at a predetermined pressure if the vane is not parallel with the first direction.

9. The dishwashing machine according to claim 1, wherein the plurality of fixed nozzles spray washing water in the second direction which is perpendicular to the first direction.

10. A dishwashing machine, comprising;

a main body;

a washing tub provided in the main body;

a basket provided in the washing tub to accommodate dishes;

a plurality of fixed nozzles fixedly arranged in a first direction of the washing tub to spray washing water in a second direction;

a vane being linearly reciprocatable in the second direction while the plurality of fixed nozzles are spraying the washing water to deflect the sprayed washing water towards dishes accommodated in the basket, wherein, when a pressure applied to the vane by the sprayed washing water is even, the vane linearly reciprocates in parallel with the first direction and, when the pressure applied to the vane by the sprayed washing water is not even, the vane linearly reciprocates at an incline to the first direction and is thereby not in parallel with the first direction;

a pressure sensor provided on the vane to sense a water pressure of the washing water sprayed by the plurality of fixed nozzles as the vane is linearly reciprocating; and a controller to compare the water pressure of washing water sensed by the pressure sensor with a predetermined value to determine whether a nozzle of the plurality of fixed nozzles is clogged.

11. A dishwashing machine, comprising;

a main body;

a washing tub provided in the main body;

a basket provided in the washing tub to accommodate dishes;

a plurality of fixed nozzles fixedly arranged in a first direction of the washing tub to spray washing water in a second direction;

a vane being linearly reciprocatable in the second direction as the washing water is sprayed from the plurality of fixed nozzles to deflect the sprayed washing water towards dishes accommodated in the basket, wherein, when a pressure applied to the vane by the sprayed washing water is even, the vane linearly reciprocates in parallel with the first direction and, when the pressure applied to the vane by the sprayed washing water is not even, the vane linearly reciprocates at an incline to the first direction and is thereby not in parallel with the first direction;

a vision sensor provided in the washing tub to sense a spray trajectory of the washing water sprayed from the plurality of fixed nozzles; and a controller to compare the spray trajectory of washing water sensed by the vision sensor with a predetermined trajectory to determine whether a nozzle of the plurality of fixed nozzles is clogged.

12. A dishwashing machine, comprising;

a main body;

a washing tub provided in the main body;

a basket provided in the washing tub to accommodate dishes;

a plurality of fixed nozzles fixedly arranged in a first direction of the washing tub to spray washing water in a second direction;

a vane being linearly reciprocatable in the second direction while the washing water is sprayed from the plurality of fixed nozzles to deflect the sprayed washing water towards dishes accommodated in the basket, wherein, when a pressure applied to the vane by the sprayed washing water is even, the vane linearly reciprocates in parallel with the first direction and, when the pressure applied to the vane by the sprayed washing water is not even, the vane linearly reciprocates at an incline to the first direction and is thereby not in parallel with the first direction;

a plurality of flow meters provided at the plurality of fixed nozzles to sense a flow rate of the washing water sprayed from the plurality of fixed nozzles; and a controller to compare the flow rate of washing water sensed by the flow meters with a predetermined value to determine whether a nozzle of the plurality of nozzles is clogged.

13. A dishwashing machine comprising:

a plurality of nozzles fixedly arranged in a first direction to spray washing water in a second direction;

a vane that, as the plurality of nozzles spray the washing water, linearly reciprocates in the second direction perpendicular to the first direction while being positioned in a trajectory of the sprayed washing water, to thereby deflect the sprayed washing water toward dishes accommodated in the dishwashing machine, wherein, when a pressure applied to the vane by the sprayed washing water is even, the vane linearly reciprocates in parallel with the first direction and, when the pressure applied to the vane by the sprayed washing water is not even, the vane linearly reciprocates at an incline to the first direction and is thereby not in parallel with the first direction; and a controller configured to, as the plurality of nozzles spray the washing water and the vane is linearly reciprocating in the second direction, determine when the vane is no longer in parallel with the first direction, and to perform an unclogging operation of at least one nozzle of the plurality of nozzles when it is determined by the controller that the vane is no longer in parallel with the first direction.

* * * * *